US006640787B2

(12) United States Patent
Hashimoto et al.

(10) Patent No.: US 6,640,787 B2
(45) Date of Patent: Nov. 4, 2003

(54) ELECTRONICALLY CONTROLLED FUEL INJECTION DEVICE

(75) Inventors: Shogo Hashimoto, Kanagawa (JP); Ryoji Ehara, Kanagawa (JP); Hiroshi Mizui, Kanagawa (JP); Tadashi Nichogi, Kanagawa (JP); Junichiro Takahashi, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/354,198

(22) Filed: Jan. 30, 2003

(65) Prior Publication Data

US 2003/0116135 A1 Jun. 26, 2003

Related U.S. Application Data

(63) Continuation of application No. PCT/JP01/06653, filed on Aug. 2, 2001.

(30) Foreign Application Priority Data

Aug. 2, 2000 (JP) ..... 2000-233938

(51) Int. Cl.[7] ..... F02M 5/04
(52) U.S. Cl. ..... 123/499; 123/514
(58) Field of Search ..... 123/499, 514

(56) References Cited

U.S. PATENT DOCUMENTS

| | | | | |
|---|---|---|---|---|
| 4,327,695 A | * | 5/1982 | Schechter | 123/499 |
| 5,469,828 A | * | 11/1995 | Heimberg et al. | 123/499 |
| 5,520,154 A | * | 5/1996 | Heimberg et al. | 123/499 |
| 6,024,071 A | * | 2/2000 | Heimberg | 123/499 |
| 6,152,113 A | * | 11/2000 | Yi | 123/499 |
| 6,240,902 B1 | * | 6/2001 | Tanaka et al. | 123/499 |
| 6,253,737 B1 | * | 7/2001 | Radue | 123/499 |
| 6,401,696 B1 | * | 6/2002 | Heimberg | 123/499 |

FOREIGN PATENT DOCUMENTS

| | | |
|---|---|---|
| CA | 2218695 | 10/1996 |
| JP | 47-21518 | 10/1972 |
| JP | 56-44450 | 4/1981 |
| JP | 56-105658 | 8/1981 |
| JP | 57-8375 | 1/1982 |
| JP | 59-183067 | 10/1984 |
| JP | 60-259768 | 12/1985 |
| JP | 62-90976 | 6/1987 |
| JP | 64-45957 | 2/1989 |
| JP | 1-163458 | 6/1989 |
| JP | 2-115567 | 4/1990 |
| JP | 3-43665 | 2/1991 |
| JP | 3-249375 | 11/1991 |
| JP | 9-133064 | 5/1997 |
| JP | 9-133065 | 5/1997 |
| JP | 2000-503745 | 3/2000 |
| WO | 96/34196 | 10/1996 |
| WO | 98/09060 | 3/1998 |

* cited by examiner

*Primary Examiner*—Thomas N. Moulis
(74) *Attorney, Agent, or Firm*—Wenderoth, Lind & Ponack, L.L.P.

(57) ABSTRACT

An electronically controlled fuel injection device includes a plunger pump, a circulation passage which circulates fuel that has been pressurized in the initial stage of a pressure-feeding stroke, a valve body which blocks the circulation passage in the later stage of the pressure-feeding stroke, an inlet orifice nozzle which allows the passage of fuel whose pressure has been increased in the later stage of the pressure-feeding stroke, an outlet orifice nozzle which is used to circulate some of the fuel that has passed through the inlet orifice nozzle back into the fuel tank, an injection nozzle which injects an amount of fuel equal to the difference between the fuel that has passed through the inlet orifice nozzle and the fuel that has passed through the outlet orifice nozzle, and a control arrangement for controlling the plunger pump in response to the cycle of the engine.

67 Claims, 21 Drawing Sheets

ELECTRONICALLY CONTROLLED FUEL INJECTION DEVICE

This application is a continuation application of international application PCT/JP01/06653, filed Aug. 2, 2001.

TECHNICAL FIELD

The present invention relates to an electronically controlled fuel injection device which is used to supply fuel to an internal combustion engine (hereafter referred to simply as an engine, and more particularly to an electronically controlled fuel injection device used in engines that are mounted in two-wheeled vehicles and the like.

BACKGROUND ART

Conventionally, electronically controlled fuel injection devices which control the fuel injection timing and amount of injection, i.e., injection period or the like, by means of an electronic circuit have been employed in four-cycle gasoline engines mounted in automobiles and the like, and especially in multi-cylinder gasoline engines with 4, 6 or 8 cylinders which have a relatively large total displacement of approximately 1000 cc to 4000 cc, from the standpoint of improving fuel economy in response to exhaust gas regulations, or from the standpoint of improving the operating characteristics.

For example, FIG. 23 shows a known electronically controlled fuel injection device. This device is a port injection type device which injects fuel toward an intake port of an engine 1 by means of an electromagnetic valve type injector 3 which is attached at an inclination toward the downstream side with respect to an intake passage inside the intake manifold 2 of the engine 1. In this port injection type electronically controlled fuel injection device, as is shown in FIG. 23, fuel (gasoline) inside a fuel tank 4 is fed out under pressure by an in-tank fuel pump 5 accommodated inside the fuel tank 4, e.g., a centrifugal flow type fuel pump. This fuel is supplied to the injector 3 via a highly pressure-resistant fuel feed pipe 7 and a delivery pipe (not shown) after passing through a high-pressure filter 6 at an intermediate point.

Furthermore, the fuel conducted by the fuel feed pipe 7 is also fed into a fuel pressure regulator 8, and the excess fuel (i.e., the fuel not injected from the injector 3) is returned to the fuel tank 4 via a fuel return pipe 9. As a result, the pressure of the fuel upstream of the injector 3 (i.e., the fuel pressure) is maintained at a specified high pressure value. Thus, since the pressure of the fuel is maintained at a high pressure, the generation of vapor in the case of high temperatures or the like is suppressed; furthermore, the fuel that is injected from the injector 3 can be finely atomized.

Furthermore, in order to detect the conditions of the engine 1 in an appropriate manner, this electronically controlled fuel injection device is equipped with an engine rotational speed sensor 10, a water temperature sensor 11, an $O_2$ sensor 12, an intake pressure sensor 13, a throttle sensor 14, and air flow rate sensor 15, an intake temperature sensor 16 and the like. On the basis of operating information concerning the engine 1 that is detected by these sensors, a control unit (ECU) 17 that is equipped with an electronic circuit calculates the current optimal fuel injection amount, i.e., the fuel injection time and fuel injection timing, and transmits this information to the injector 3. As a result, the injection time and injection timing of the fuel from the injector 3 are optimally controlled in accordance with the operating conditions of the engine 1.

Meanwhile, in the case of engines with a relatively small displacement that are mounted in two-wheeled vehicles or comparable vehicles, or in other engine-driven devices, e.g., engines with a displacement of approximately 50 cc to 250 cc per cylinder, fuel injection devices using carburetors or the like that control the amount of fuel injection by means of pressure have been employed in the past, one reason being that exhaust gas regulations and the like were not too strict for such engines.

However, as a recent step in the prevention of global warming and environmental protection, fine control of combustion for the purpose of reducing emissions of carbon dioxide, hydrocarbons and the like by reducing fuel consumption has become necessary even in such engines with a small displacement.

When an attempt is made to achieve optimal fuel injection in the same manner as in large-displacement automobile engines by using systems similar to existing electronically controlled fuel injection devices instead of conventional carburetors, the following problems arise.

First of all, in the case of an electronically controlled fuel injection device using a conventional fuel pump 5 and injector 3, either time or area is used as a control parameter in controlling the amount of fuel injection and the like. Accordingly, the flexibility of control, i.e., the control range, is narrow, so that such devices are undesirable in the case of engines mounted in two-wheeled vehicles and the like, in which it is necessary to perform optimal control of the combustion while giving serious consideration to the operating performance from the standpoint of the application involved.

Secondly, conventional fuel pumps 5 are centrifugal flow type fuel pumps, and have a relatively large and complicated structure equipped with pump parts, motor parts and the like. Furthermore, an in-tank installation system in which the fuel pump is disposed inside the fuel tank 4 is generally employed; as a result, for example, it is difficult to fit such a fuel pump in a two-wheeled vehicle engine in which there are restrictions on the size and shape of the fuel tank.

Third, since the fuel feed pipe 7 extending from the fuel pump 5 to the injector 3 is filled with high-pressure fuel, such a system is undesirable from the standpoint of safety in the case of engines mounted in two-wheeled vehicles, in which accidental spills (i.e., accidents in which two-wheeled vehicles are laid down) and the like must be taken into consideration.

Fourth, in the case of conventional systems which supply fuel at a high pressure, the electric power consumption of the fuel pump 5 itself is large; furthermore, it is necessary to circulate fuel at a high flow rate via the fuel pressure regulator 8. As a result, the overall electric power consumption is increased even further. Accordingly, such systems are undesirable for engines mounted in two-wheeled vehicles and the like, in which there is a need to reduce the electric power consumption.

Fifth, in the case of conventional systems which supply fuel at a high pressure, a high pressure resistance is required, so that such systems are generally expensive, including the cost of the materials of the constituent parts, the cost of high quality control during manufacture and the like. Accordingly, such systems are undesirable for engines mounted in two-wheeled vehicles, in which there is a demand for cost reduction.

The present invention was devised in light of the above-mentioned problems encountered in the prior art. It is an object of the present invention to provide an electronically controlled fuel injection device which makes it possible to achieve an optimal combustion state by means of precise control such that exhaust gas countermeasures are also performed while maintaining the operating performance in a small-displacement engine, e.g., an engine mounted in a two-wheeled vehicle or the like, and at the same time achieving a reduction in electric power consumption, a reduction in cost, a reduction in size and a reduction in the installation space required.

SUMMARY OF THE INVENTION

The first electronically controlled fuel injection device of the present invention is an electronically controlled fuel injection device which injects fuel into the intake passage of an engine, comprising a volume type (i.e., positive displacement) electromagnetically driven pump which uses electromagnetic force as a driving source, and which pressure-feeds fuel conducted from the fuel tank, an inlet orifice nozzle which has an orifice part that allows the passage of the fuel that is pressure-fed by this electromagnetically driven pump, an outlet orifice nozzle which has an orifice part that allows the passage of fuel so that a specified amount of the fuel that has passed through the inlet orifice nozzle is circulated back to the fuel tank, an injection nozzle which injects an amount of fuel equal to the difference between the fuel that has passed through the inlet orifice nozzle and the fuel that has passed through the outlet orifice nozzle into the intake passage, and a control arrangement for controlling the electromagnetically driven pump in response to the engine cycle.

In this construction, when a specified driving signal is sent to the electromagnetically driven pump by the control arrangement, the electromagnetically driven pump is actuated by the electromagnetic force that is generated, so that a specified amount of fuel is pressure-fed. Then, the pressure-fed fuel passes through the inlet orifice nozzle and is adjusted to a flow rate (pressure) that corresponds to the driving signal, and a portion of the fuel that flows out from this inlet orifice nozzle passes through the outlet orifice nozzle and is circulated back into the fuel tank. Furthermore, an amount of fuel equal to the difference between the fuel that has passed through the inlet orifice nozzle and the fuel that has passed through the outlet orifice nozzle is injected into the intake passage from the injection nozzle.

Here, the inlet orifice nozzle acts as a sensor that detects the fuel flow rate by the pressure difference before and after the inlet orifice nozzle; furthermore, the outlet orifice nozzle acts to apply a bias to the flow rate through the inlet orifice nozzle, so that the region of strong nonlinearity of the small-flow-rate region is not used in the flow rate characteristics of the inlet orifice nozzle.

In the above-mentioned construction, the electromagnetically driven pump may comprise a cylindrical body (plunger-receiving body) that forms a fuel passage, a plunger which is disposed in tight contact with the inside of the passage of this cylindrical body so that the plunger is free to undergo reciprocating motion within a specified range, and which has a fuel passage that passes through in the direction of the reciprocating motion, a first check valve which is urged so that the fuel passage of the plunger is blocked, and which is disposed so that the fuel passage is opened by the movement of the plunger in one direction, an elastic body which is supported on the cylindrical body, and which urges the plunger in the direction of the reciprocating motion, a second check valve which is disposed on the downstream side of the plunger with respect to the direction of flow of the fuel, and which is urged so that the passage of the cylindrical body is blocked, and disposed so that that the passage of the cylindrical body is opened by the movement of the plunger in the other direction, and a solenoid coil which applies an electromagnetic force to the plunger.

In this construction, when the plunger is caused to begin an advancing motion (in the above-mentioned second direction) by the exciting action of the solenoid coil from the resting position in which the plunger is held in a specified position inside the cylindrical body by the elastic body, the second check valve opens the passage of the cylindrical body, so that fuel is pressure-fed toward the inlet orifice nozzle. On the other hand, when the plunger that has reached a specified position begins a return motion (in the above-mentioned first direction), the second check valve blocks the passage of the cylindrical body, and at the same time, the first check valve opens the fuel passage of the plunger, so that fuel is sucked in behind the plunger, i.e., toward the downstream side. Thus, fuel at a specified pressure is pressure-fed toward the inlet orifice nozzle by the reciprocating action of the plunger.

Furthermore, the second electronically controlled fuel injection device of the present invention is an electronically controlled fuel injection device which injects fuel into the intake passage of the engine, comprising a volume type (i.e. positive displacement) electromagnetically driven pump which uses electromagnetic force as a driving source, and which pressure-feeds fuel conducted from the fuel tank, a circulation passage which circulates fuel that has been pressurized to a specified pressure or greater in a specified initial stage of the pressure-feeding stroke performed by the electromagnetically driven pump back into the fuel tank, a valve body which blocks the circulation passage in the later stage of the pressure-feeding stroke but not the initial stage, an inlet orifice nozzle which has an orifice part that allows the passage of fuel pressurized to a specified pressure in the later stage of the pressure-feeding stroke, an outlet orifice nozzle which has an orifice part that allows the passage of fuel so that a specified amount of the fuel that has passed through the inlet orifice nozzle is circulated back into the fuel tank, an injection nozzle which injects an amount of fuel equal to the difference between the fuel that has passed through the inlet orifice nozzle and the fuel that has passed through the outlet orifice nozzle into the intake passage, and a control arrangement for controlling the electromagnetically driven pump in response to the engine cycle.

In this construction, fuel mixed with vapor which is pressurized to a specified pressure or greater in the initial stage of the pressure-feeding stroke performed by the electromagnetically driven pump is circulated back into the fuel tank via the circulation passage. Furthermore, in the later stage of the pressure-feeding stroke, the valve body blocks the circulation passage, so that the pressure of the fuel is elevated to a specified pressure, and the fuel passes through the inlet orifice nozzle and is adjusted (metered) to a flow rate (pressure) that corresponds to the driving signal. Then, a portion of the fuel that has flowed out from this inlet orifice nozzle passes through the outlet orifice nozzle and is circulated back to the fuel tank. Meanwhile, an amount of fuel equal to the difference between the fuel that has passed through the inlet orifice nozzle and the fuel that has passed through the outlet orifice nozzle is injected into the intake passage from the injection nozzle. Thus, since the fuel mixed with vapor is circulated back to the fuel tank before being metered by the inlet orifice nozzle, the control of the amount of fuel injected is stabilized, especially at high temperatures.

Furthermore, the third electronically controlled fuel injection device of the present invention is an electronically controlled fuel injection device which injects fuel into the intake passage of the engine, comprising a positive displacement electromagnetically driven pump which uses electromagnetic force as a driving source, and which pressure-feeds fuel conducted from the fuel tank, a circulation passage which circulates fuel that has been pressurized to a specified pressure or greater in a specified initial stage of the pressure-feeding stroke performed by the electromagnetically driven pump back into the fuel tank, a valve body which blocks the circulation passage in the later stage of the pressure-feeding stroke but not the in the initial stage, an inlet orifice nozzle which has an orifice part that allows the passage of fuel pressurized to a specified pressure in the later stage of the pressure-feeding stroke, an injection nozzle which injects the fuel that has passed through the inlet orifice nozzle into the intake passage in cases where the pressure of the fuel is equal to or greater than a specified pressure, and a control arrangement for controlling the electromagnetically driven pump in response to the engine cycle.

In this construction, fuel mixed with vapor which is pressurized to a specified pressure or greater in the initial stage of the pressure-feeding stroke performed by the electromagnetically driven pump is circulated back into the fuel tank via the circulation passage. Furthermore, in the later stage of the pressure-feeding stroke, the valve body blocks the circulation passage, so that the pressure of the fuel is elevated to a specified pressure, and the fuel passes through the inlet orifice nozzle and is adjusted (metered) to a flow rate (pressure) that corresponds to the driving signal. Then, when the fuel that has flowed out from this inlet orifice nozzle reaches a specified pressure or greater, this fuel is injected into the intake passage from the injection nozzle. Thus, since the fuel mixed with vapor is circulated back to the fuel tank before being metered by the inlet orifice nozzle, the control of the amount of fuel injected is stabilized, especially at high temperatures.

In both of the above-mentioned constructions, a construction may be employed in which the electromagnetically driven pump has a cylindrical body that forms a fuel passage, a plunger which is disposed in tight contact with the inside of the passage of the cylindrical body so that the plunger is free to undergo a reciprocating motion within a specified range, and which sucks in fuel by moving in one direction and pressure-feeds this sucked-in fuel by moving in the other direction, an elastic body which urges the plunger in the direction of the reciprocating motion, an outlet check valve which opens a fuel passage that communicates with the inlet orifice nozzle when the fuel that is pressure-fed by the plunger reaches a specified pressure or greater, and a solenoid coil which applies an electromagnetic force to the plunger; the above-mentioned circulation passage is formed so that this passage passes through the above-mentioned plunger in the direction of the reciprocating motion of the plunger, and a pressurizing valve is provided which is urged so that this valve blocks the circulation passage, and which opens when the pressure-fed fuel reaches a specified pressure or greater; and the above-mentioned valve body consists of a spill valve which is disposed in a manner that allows this valve to undergo reciprocating motion in the direction of the reciprocating motion of the plunger, so that the circulation passage is opened in the initial stage of the pressure-feeding stroke and blocked in the later stage of the pressure-feeding stroke, and so that the outlet check valve is opened at an intermediate point in this later stage.

Furthermore, in both of the above-mentioned constructions, a construction may be employed in which the electromagnetically driven pump has a cylindrical body that forms a fuel passage, a plunger which is disposed in tight contact with the inside of the passage of the cylindrical body so that the plunger is free to undergo reciprocating motion within a specified range, and which sucks in fuel by moving in one direction and pressure-feeds this sucked-in fuel by moving in the other direction, an elastic body which urges the plunger in the direction of the reciprocating motion, an outlet check valve which opens a fuel passage that communicates with the inlet orifice nozzle when the fuel that is pressure-fed by the plunger reaches a specified pressure or greater, and a solenoid coil which applies an electromagnetic force to the plunger; the above-mentioned circulation passage is formed on the outside of the cylindrical body; a pressurizing valve which is driven so that this valve blocks the circulation passage, and which opens the circulation passage when the fuel that is pressure-fed by the plunger reaches a specified pressure or greater, is installed on the circulation passage; a spill port which communicates with the circulation passage is formed in the above-mentioned cylindrical body; and the above-mentioned valve body is constituted by of the above-mentioned plunger, which opens the spill port in the initial stage of the pressure-feeding stroke, and closes the spill port in the later stage of the pressure-feeding stroke.

In this construction, when the fuel that is sucked in in the initial stage of the pressure-feeding stroke performed by the plunger reaches a specified pressure or greater, the pressurizing valve opens the circulation passage that is formed on the outside of the cylindrical body, so that fuel mixed with vapor flows out from the spill port formed in the side wall of the cylindrical body, and is circulated back to the fuel tank. Then, when the plunger moves further and enters the later stage of the pressure-feeding stroke, (the outer circumferential surface of) the plunger blocks the spill port, and the fuel is further pressurized. Then, when the fuel is pressurized to a specified pressure or greater, the outlet check valve opens the fuel passage, so that the pressurized fuel passes through the inlet orifice nozzle.

In the constructions of the above-mentioned second and third electronically controlled fuel injection devices, a construction may be employed in which the circulation passage is formed so that the fuel is circulated in the opposite direction from the direction of injection of the fuel by the injection nozzle.

In this construction, since circulation is performed in the opposite direction from the direction of injection of the fuel, the vapor that is mixed with the fuel can be positively expelled. Especially in cases where the injection direction is oriented substantially downward in the vertical direction, the circulation direction is oriented substantially upward in the vertical direction; accordingly, the vapor is positively expelled by buoyancy.

In the constructions of the above-mentioned first and second electronically controlled fuel injection devices, a construction may be employed in which the injection nozzle has a cylindrical body (valve-receiving body) which demarcates a fuel passage that communicates with the above-mentioned inlet orifice nozzle and outlet orifice nozzle, a valve body which is disposed so that this valve body is free to undergo reciprocating motion inside the cylindrical body, and which opens and closes the fuel injection passage, and an urging spring which urges the valve body by means of a specified urging force so that the fuel injection passage is blocked.

In this construction, fuel at a specified pressure flows into the cylindrical body from the inlet orifice nozzle;

meanwhile, fuel at a specified flow rate flows out from the outlet orifice nozzle and is circulated back into the fuel tank. Here, when the fuel that flows in from the inlet orifice nozzle increases so that the pressure inside the cylindrical body is increased, the valve body moves against the urging force of the urging spring and opens the injection passage, so that fuel is injected from the injection nozzle. As a result, the pressure inside the cylindrical body is maintained at a constant value. Specifically, an amount of fuel equal to the difference between the fuel that has flowed in from the inlet orifice nozzle and the fuel that has flowed out from the outlet orifice nozzle is injected from the injection nozzle as injected fuel.

In the construction of the above-mentioned third electronically controlled fuel injection device, a construction may be employed in which the injection nozzle has a cylindrical body which demarcates a fuel passage that conducts fuel that has flowed in from the inlet orifice nozzle, a valve body which is disposed so that this valve body is free to undergo reciprocating motion inside the cylindrical body, and which opens and closes the fuel injection passage, and an urging spring which urges the valve body by means of a specified urging force so that the fuel injection passage is blocked.

In this construction, fuel at a specified pressure flows into the cylindrical body from the inlet orifice nozzle, and when the pressure inside this cylindrical body further rises to a specified pressure, the valve body moves against the urging force of the urging spring and opens the injection passage, so that fuel is injected from the injection nozzle.

In the above-mentioned construction, a construction may be employed in which an assist air passage that allows the passage of assist air used to assist in the atomization of the injected fuel is formed in the injection nozzle.

In this construction, when fuel is injected from the injection nozzle, air that is caused to jet through the assist air passage agitates the injected fuel so that atomization of the injected fuel is promoted.

Furthermore, in the above-mentioned construction, a construction may be employed in which an adjustment mechanism for adjusting the urging force of the urging spring is installed in the injection nozzle.

In this construction, the opening pressure (relief pressure) of the valve body is adjusted to the desired value by appropriately adjusting the urging force of the urging spring using the adjustment mechanism.

In the constructions of the above-mentioned first and second electronically controlled fuel injection devices, a construction may be employed in which a back-flow preventing valve which prevents back flow in the fuel passage is installed in the injection nozzle.

In this construction, the pressure of the fuel inside the fuel passage on the upstream side of the back-flow preventing valve is raised and maintained at a specified value, so that the generation of vapor is suppressed. Furthermore, the back flow of vapor conducted toward the outlet orifice nozzle on the downstream side from the fuel passage is prevented, so that the discharge of vapor is efficiently performed.

In the above-mentioned construction, a construction may also be employed in which an adjuster that adjusts the opening pressure of the above-mentioned back-flow preventing valve is installed in the injection nozzle.

In this construction, the opening pressure of the back-flow preventing valve is adjusted to an appropriate desired value by adjusting the adjuster.

In the constructions of the above-mentioned first and second electronically controlled fuel injection devices, a construction may be employed in which a fuel passage that communicates with the inlet orifice nozzle and outlet orifice nozzle is formed in the injection nozzle as a passage that passes through the vicinity of the injection passage that is opened and closed by the valve body, and allows fuel to flow in one direction.

In this construction, the fuel that has flowed in from the inlet orifice nozzle is conducted to the vicinity of the injection passage that is opened and closed by the valve body, and is injected as necessary; furthermore, the fuel that is not injected flows toward the outlet orifice nozzle on the downstream side. Thus, as a result of the fuel forming a one-way flow, the accumulation of vapor is prevented; furthermore, the injection nozzle is cooled by the fuel.

In the above-mentioned construction, a construction may be employed in which the electromagnetically driven pump and injection nozzle are joined as an integral unit.

In this construction, the electromagnetically driven pump and injection nozzle are treated as a single module as in conventional injectors; this contributes to convenience in terms of handling.

In the above-mentioned construction, at least two characteristics, i.e., the current that flows through the solenoid coil of the electromagnetically driven pump and the time for which this current flows, are used as control parameters for the control arrangement.

In this construction, at least two characteristics, i.e., the current that flows through the solenoid coil, i.e., the pressure of the fuel into which this current is converted via the electromagnetic force, and the time for which this current flows, are used as control parameters; accordingly, compared to conventional single-element control using time only, a desired precise fuel injection pattern can be formed; furthermore, the control width is increased, and the transient response characteristics are also advantageous.

In the construction of the above-mentioned third electronically controlled fuel injection device, a construction may be employed in which the control arrangement uses only the time for which current is caused to flow through the electromagnetically driven pump as a control parameter.

In this construction, a pressure-feeding operation of fuel from which vapor has been expelled beforehand by the plunger is performed by causing a predetermined current to flow for a specified period of time, so that fuel at a relatively high pressure passes through the inlet orifice nozzle. Accordingly, the inlet orifice nozzle can be used in a region of good linearity. Furthermore, the fuel that is metered by being passed through the inlet orifice nozzle is further raised to a specified pressure so that the valve body opens the injection passage and fuel is injected.

In the constructions of the above-mentioned first and second electronically controlled fuel injection devices, a construction may be used in which the control arrangement drives the electromagnetically driven pump by superimposed driving in which an auxiliary pulse that is smaller than a specified level is superimposed on a fundamental pulse consisting of a current of this specified level.

In this construction, when the electromagnetically driven pump is driven, the pump is driven with an auxiliary pulse superimposed on the fundamental pulse; accordingly, the amount of fuel that is circulated from the outlet orifice nozzle is increased, and the admixed vapor is efficiently expelled.

Furthermore, in the above-mentioned construction, the control arrangement may cause the solenoid coil to be powered at least during the pressure-feeding stroke of the plunger that forms a part of the electromagnetically driven pump.

In this construction, the plunger is caused to initiate the pressure-feeding operation by the excitation of the solenoid coil so that fuel is discharged. Here, the amount of fuel that is discharged and the mixing conditions (uniform mixing or non-uniform mixing) can be precisely controlled by appropriately adjusting the current that is passed through in this case and the time for which this current is passed through.

DETAILED DESCRIPTION OF THE INVENTION

Figure 1:
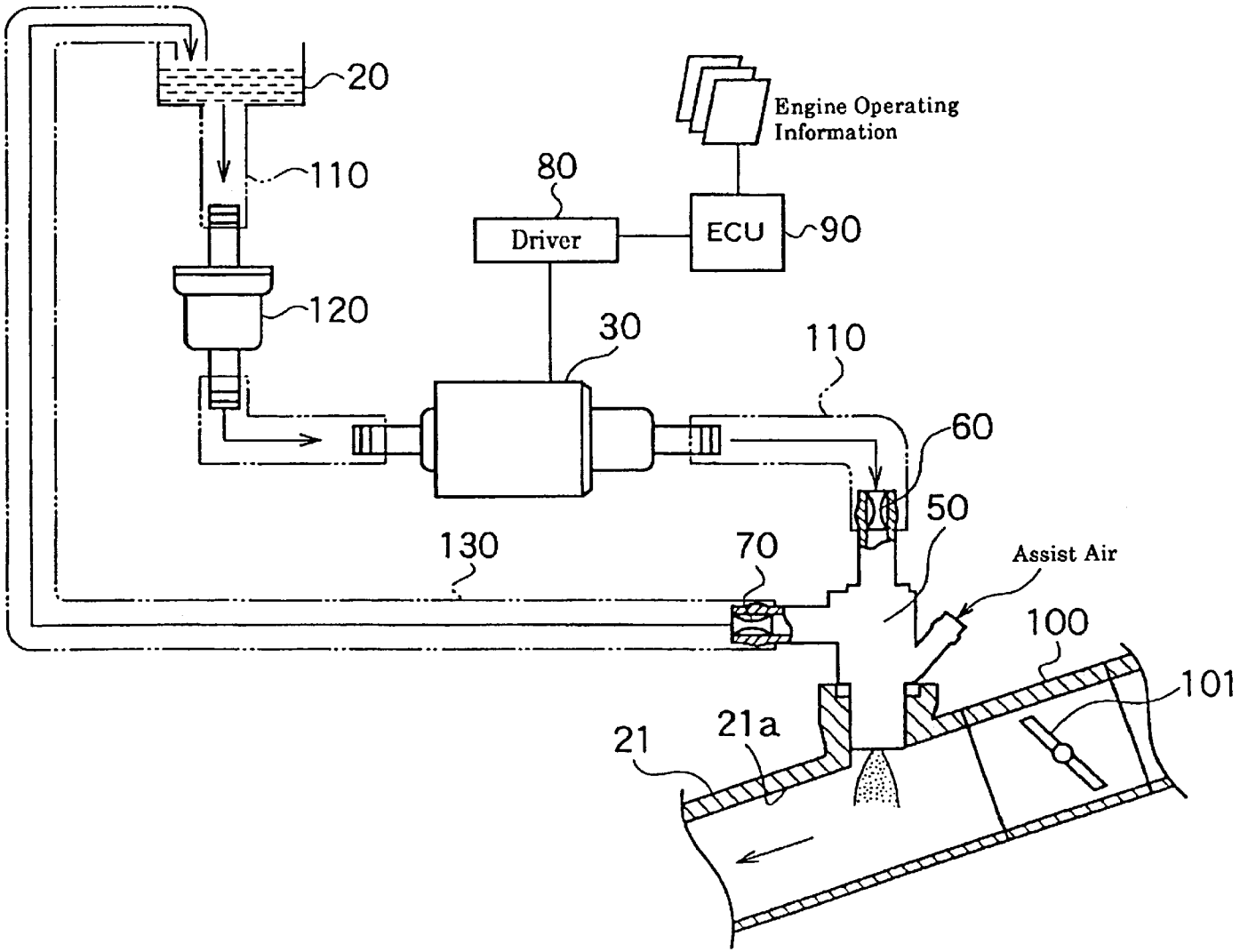
FIG. 1 is a schematic structural diagram which illustrates the overall construction of an electronically controlled fuel injection device according to an embodiment of the present invention.

FIG. 1 is a schematic structural diagram which illustrates one embodiment of a first electronically controlled fuel injection device of the present invention. As is shown in FIG. 1, the electronically controlled fuel injection device of this embodiment comprises, as basic constituent elements, a plunger pump 30 used as an electromagnetically driven pump that pressure-feeds fuel from a fuel tank 20 of a two-wheeled vehicle, an injection nozzle 50 which injects fuel into an intake passage 21*a* of an intake manifold 21 that forms a part of an engine, an inlet orifice nozzle 60 which is disposed on an downstream side of the plunger pump 30 and an upstream side of the injection nozzle 50, and which is integrally joined to the injection nozzle 50, an outlet orifice nozzle 70 which is disposed between the injection nozzle 50 and the fuel tank 20, and which is integrally joined to the injection nozzle 50, and a driver 80 and control unit (ECU) 90 used as control means that send control signals to the plunger pump 30 and the like on the basis of engine operating information.

Furthermore, as other constituent elements, the electronically controlled fuel injection device comprises a sensor which is used to detect the operating conditions of the engine, a rotational speed sensor which detects the rotational speed of the crankshaft, a water temperature sensor which detects the temperature of the engine coolant water, a pressure sensor which detects the pressure of the intake air inside the intake passage 21*a,* and a throttle opening sensor which is connected to the intake manifold 21, and which detects the degree of opening of a throttle valve 101 in a throttle body 100 that forms a part of the intake passage 21*a* (none of these sensors is shown in the figures).

In addition, the electronically controlled fuel injection device may also comprise an $O_2$ sensor that detects the amount of oxygen in the exhaust manifold, an air flow rate sensor that detects the air flow rate in the intake passage, and an intake air temperature sensor that detects the temperature of the intake air inside the intake passage (none of these sensors is shown in the figures).

Here, to describe the fuel path, the fuel tank 20 and inlet orifice nozzle 60 are connected by a fuel feed pipe 110, and a low-pressure filter 120 and plunger pump 30 are connected in an in-line configuration at intermediate points in the fuel feed pipe 110 in that order from the upstream side.

Accordingly, fuel that has passed through a fuel filter (not shown in the figures) disposed inside the fuel tank 20, and the low-pressure filter 120, is pressure-fed by the plunger pump 30, and passes through the inlet orifice nozzle 60, so that this fuel is supplied to the injection nozzle 50.

Furthermore, the outlet orifice nozzle 70 and fuel tank 20 are connected by a fuel return pipe 130, and fuel at a specified flow rate (described later) is circulated back into the fuel tank 20 via the fuel return pipe 130.

Thus, since a plunger pump 30 that can be installed in-line is employed as a fuel supply system, the degree of freedom of layout or design is increased when this system is used in an engine that is mounted in a two-wheeled vehicle or the like; furthermore, since a conventional fuel tank and the like can be used s is the overall cost can be reduced.

Figure 2:
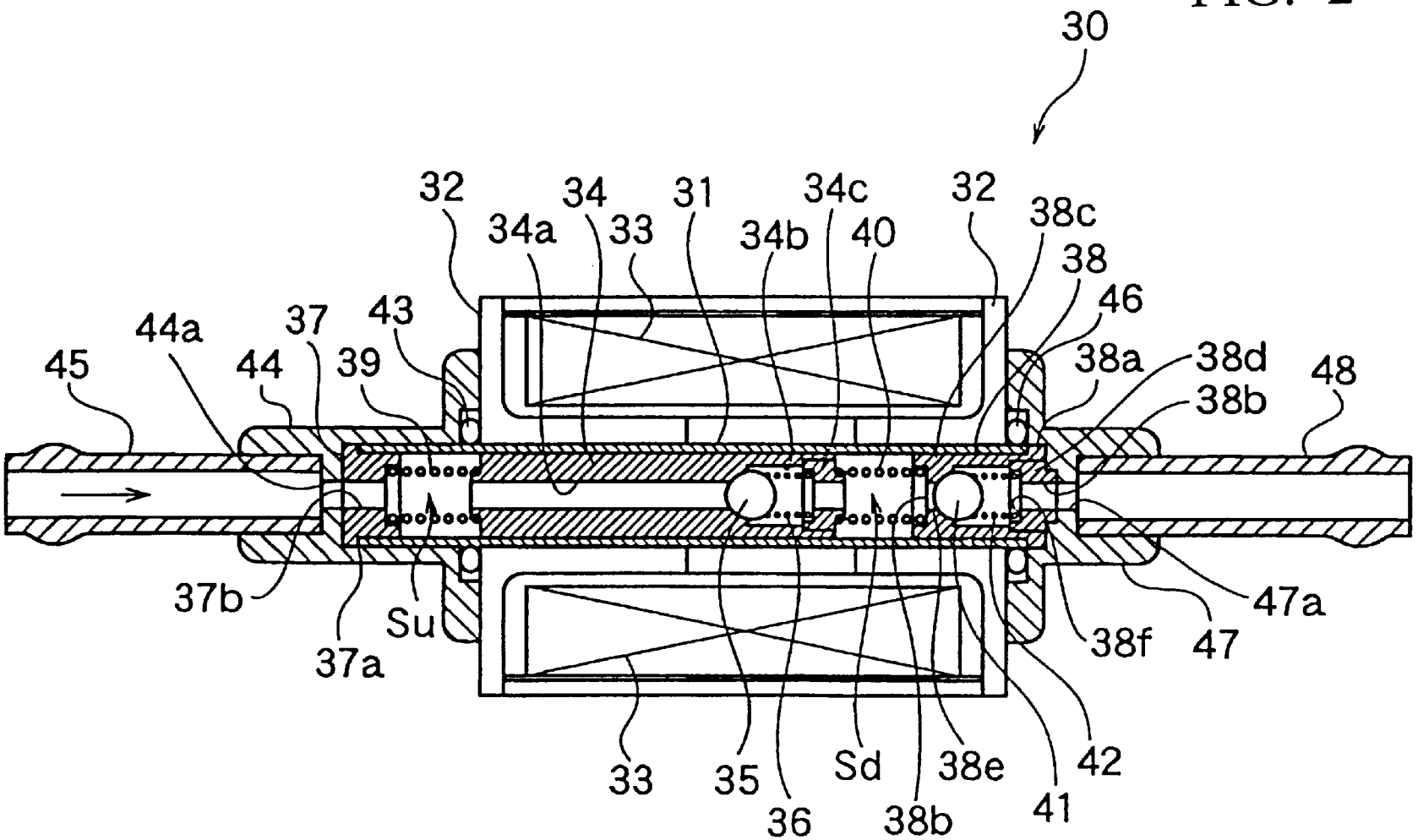
FIG. 2 is a sectional view which illustrates the schematic construction of a plunger pump comprising an electromagnetically driven pump that constitutes a part of the electronically controlled fuel injection device.

Here, to describe the plunger pump 30, this fuel pump is an electromagnetically driven volume type (i.e. positive displacement) pump. As is shown in FIG. 2, a core 32 is joined to the outer circumference of a cylinder 31 comprising a cylindrical body that has a cylindrical shape, and a solenoid coil 33 is wound around the outer circumference of the core 32. A plunger 34, comprising a movable body having a specified length, is inserted into the interior of the cylinder 31 so that the plunger 34 is in tight contact with the cylinder 31, and the plunger 34 is free to undergo reciprocating motion by sliding through the cylinder 31 in the axial direction.

A fuel passage 34*a* which passes through the plunger 34 in the direction of the reciprocating motion of the plunger 34 (i.e., in the axial direction) is formed in the plunger 34; furthermore, a radially expanded fuel passage part 34*b* is formed at one end of the fuel passage 34*a* (the downstream end with respect to the direction of flow of the fuel). Moreover, a first check valve 35 and a first coil spring 36 that urges the first check valve 35 toward the upstream side, i.e., toward the fuel passage 34*a,* are disposed inside the expanded part 34*b.* A stopper 34*c,* which forms a part of the plunger 34 and has a central fuel passage, is engaged with the outside end portion of the expanded part 34*b.* One end of the first coil spring 36 is held by the end surface of the stopper 34*c.*

Specifically, the fuel passage 34*a* of the plunger is ordinarily blocked by the first check valve 35 urged by the first coil spring 36; then, when a pressure difference equal to or greater than a specified value (pressure oil the side of the fuel passage 34*a*>pressure on the side of the expanded part 34*b*) is generated in the spaces on opposite sides of the first check valve 35 (fuel passage 34*a* and expanded part 34*b*), the first check valve 35 opens the fuel passage 34*a.* Furthermore, the first check valve 35 is not limited to a spherical valve as shown in the figures; a hemispherical valve or disk-shaped valve may also be used. Moreover, the material of the valve may be rubber or steel.

Furthermore, a first supporting member 37 and a second supporting member 38 are respectively mounted on opposite end portions of the cylinder 31. A second coil spring 39 is disposed between the first supporting member 37 and one end portion of the plunger 34, and a third coil spring 40 is disposed between the second supporting member 38 and the other end portion (stopper 34*c*) of the plunger 34. The second coil spring 39 and the third coil spring 40 form elastic bodies that drive the plunger 34 in the directions of the reciprocating motion.

The first supporting member 37 is formed as a cylindrical body which has a flange part 37*a* that protrudes in the radial direction, and a fuel passage 37*b* is defined in the interior of the supporting member 37. The supporting member 37 is engaged inside the cylinder 31 in a state in which the flange part 37*a* is caused to contact one end surface of the cylinder 31.

The second supporting member 38 is formed as a cylindrical body which has a flange part 38*a,* and is formed by an outside cylindrical part 38*c* inside which a fuel passage 38*b* is defined, and an inside cylindrical part 38*d* in which a fuel passage 38*b* is similarly defined, and which is engaged with the above-mentioned outside cylindrical part 38*c.* The outside cylindrical part 38*c* is engaged inside the cylinder 31 in a state in which the flange part 38*a* is caused to contact the other end surface of the cylinder 31.

Furthermore, a reduced-diameter part 38*e* is formed inside the outside cylindrical part 38*c,* and the third coil spring 40 is caused to contact one end surface of the reduced-diameter part 38*e.* Furthermore, a spot facing part 38*f* is formed inside the inside cylindrical part 38, and a spherical second check valve 41 and a fourth coil spring 42 that urges the second check valve 41 toward the upstream side, i.e., toward the reduced-diameter part 38*e,* are disposed in the space demarcated by the end surface of the spot facing part 38*f* and the other end surface of the reduced-diameter part 38*e.*

Specifically, the fuel passage 38*b* is ordinarily blocked by the second check valve 41 urged by the fourth coil spring 42; then, when a pressure difference equal to or greater than a specified value (pressure on upstream side>pressure on downstream side) is generated in the spaces on opposite sides of the second check valve 41, the second check valve 41 opens the fuel passage 38*b.* Furthermore, the second check valve 41 is not limited to a spherical valve as shown in the figures; a hemispherical valve or disk-shaped valve may also be used. Moreover, the material of the valve may be rubber or steel.

Furthermore, an outside core 44 is joined to the outside of the first supporting member 37 and cylinder 31 via an O-ring 43 so that the outside core 44 surrounds the first supporting member 37 and cylinder 31. An axially extending fuel passage 44*a* is formed through the outside core 44, and an inlet pipe 45 is engaged in an outside region of the outside core 44.

Furthermore, an outside core 47 is joined to the outside of the second supporting member 38 and cylinder 31 via an O-ring 46 so that the outside core 47 surrounds the second supporting member 38 and cylinder 31. An axially extending fuel passage 47*a* is formed through the outside core 47, and an outlet pipe 48 is engaged in an outside region of the outside core 47.

In the above construction, the overall fuel passage is formed by the internal passage of the inlet pipe 45, the fuel passage 44*a* of the outside core 44, the fuel passage 37*b* of the first supporting member 37, the internal passage of the cylinder 31, the fuel passage 34*a* of the plunger 34, the fuel passage 38*b* of the second supporting member 38, the fuel passage 47*a* of the outside core 47, and the internal passage of the outlet pipe 48.

Furthermore, in the above-mentioned construction, in the resting state in which the solenoid coil 33 is not powered, the plunger 34 is stopped in a position in which the urging forces of the mutually antagonistic second coil spring 39 and third coil spring 40 are balanced (i.e., in the resting position shown in FIG. 2), so that an upstream-side space Su which contains the second coil spring 39 and a downstream-side space Sd which contains the third coil spring 40 are demarcated.

Furthermore, both end portions of the plunger 34 are supported by the second coil spring 39 and third coil spring 40; accordingly, the generation of a percussive noise or the like caused by the impact of the plunger 34 can be prevented.

In the above-mentioned resting state, when the solenoid coil 33 is powered so that an electromagnetic force is generated, the plunger 34 is drawn toward the downstream side (toward the right side in FIG. 2) against the urging force of the third coil spring 40, and initiates an advancing motion. As a result of the advancing motion of the plunger 34, the fuel that has been sucked into the downstream-side space Sd begins to be compressed; then, at the point in time where the downstream-side spaced Sd reaches a specified pressure, the second check valve 41 opens the fuel passage 38*b* against the urging force of the fourth coil spring 42. As a result, the fuel filling the downstream-side space Sd is discharged at a specified pressure via the outlet pipe 48.

Furthermore, when the plunger 34 has moved a specified distance, and the power to the solenoid coil 33 is switched off so that the advancing motion is completed, or when the power is switched off immediately after an instantaneous powering for the purpose of starting, so that the advancing motion of the plunger 34 is completed in balance with the urging force of the third coil spring 40, the second check valve 41 simultaneously), blocks the fuel passage 38*b*.

Then, the plunger 34 is caused to initiate a return motion toward the upstream side (toward the left side in FIG. 2) by the urging force of the third coil spring 40, which has been heightened by compression. At this time, the upstream-side space Su is contracted, and the downstream-side space Sd is expanded. Furthermore, since the second check valve 41 has blocked the fuel passage 38*b*, the pressure in the downstream-side space Sd drops.

Then, at the point in time where the pressure in the upstream-side space Su exceeds a specified value relative to the pressure in the downstream-side space Sd, the first check valve 35 opens the fuel passage 34*a* against the urging force of the first coil spring 36. As a result, the fuel in the upstream-side space Su is sucked into the downstream-side space Sd via the fuel passage 34*a*.

Regarding the driving of the plunger 34, as was described above, the solenoid coil 33 is powered during the advancing motion of the plunger 34. Thus, powering of the solenoid coil 33 initiates advancing motion of the plunger 34 and causes discharging of fuel. In this case, the amount of fuel that is discharged and the conditions of mixing (uniform mixing or non-uniform mixing) can be precisely controlled by appropriately adjusting the current that powers the solenoid coil 33 and the time for which the solenoid coil 33 is powered.

Furthermore, the above-mentioned driving method is a powered discharge method in which fuel is discharged when the solenoid coil 33 is powered; however, it would also be possible to perform a non-powered discharge (spring feed-out) in which fuel is sucked in when the solenoid coil 33 is powered, and discharged by the urging force of the second coil spring 39 when the solenoid coil 33 is not powered.

The driving method used for the plunger pump 30 will be described in detail later; for example, a pulse driving control method such as constant-voltage fall control, pulse width modulation (PWM) control or the like can be used.

In cases where a plunger pump 30 of the type described above is used, no particles of debris caused by wear of motor brushes or the like are generated. Accordingly, there is no need for a high-pressure filter on the downstream side as in conventional devices, so that the cost of the overall apparatus can be decreased by a corresponding amount.

Figure 3:
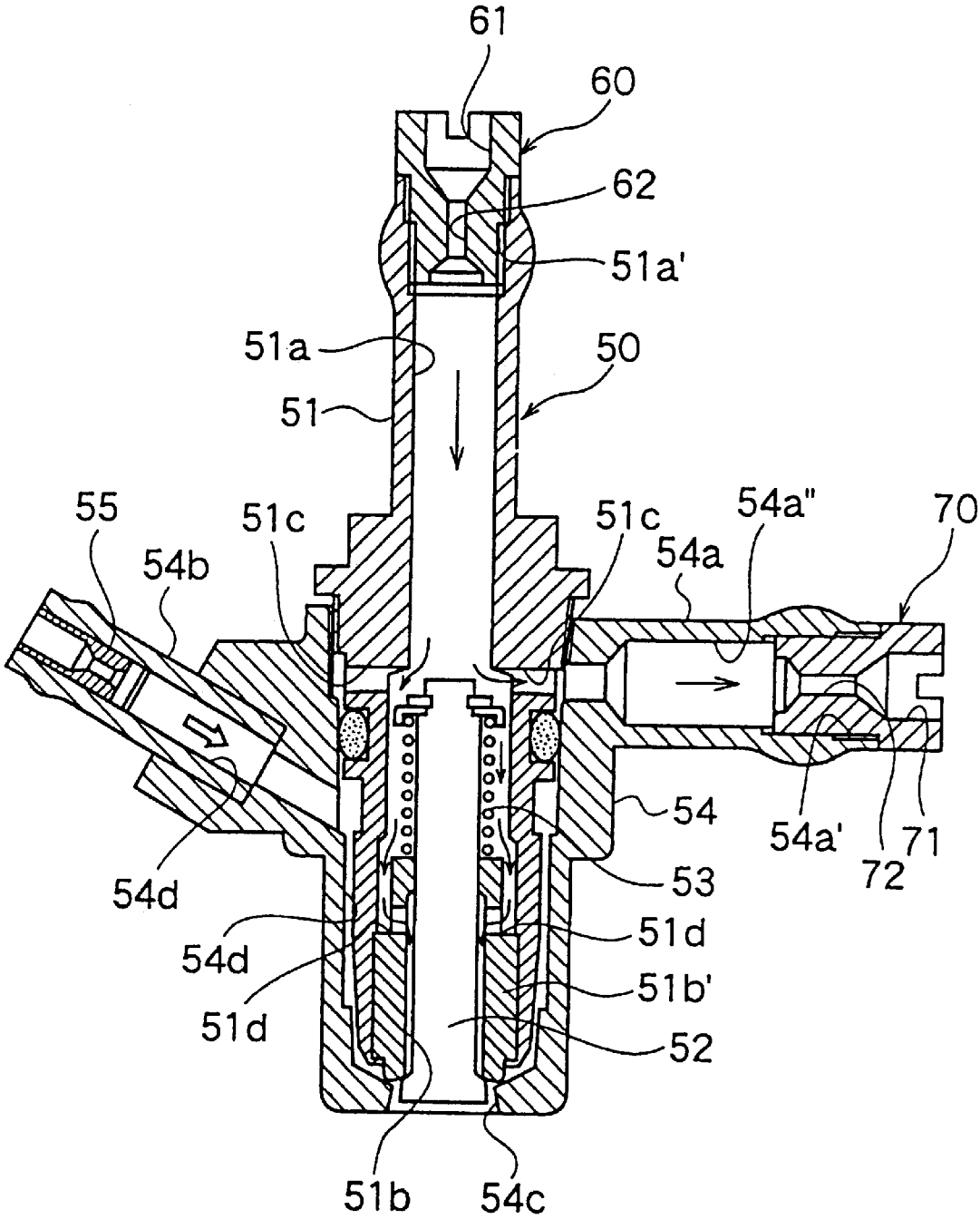
FIG. 3 is a sectional view which illustrates the construction of an injection nozzle, an inlet orifice nozzle, an outlet orifice nozzle and an assist air passage that constitute parts of the electronically controlled fuel injection device.

As is shown in FIG. 3, the injection nozzle 50 comprises a cylindrical body 51 which demarcates a fuel passage 51*a* that communicates with the inlet orifice nozzle 60 and outlet orifice nozzle 70, a poppet valve body 52 which is disposed inside the cylindrical body 51 so that the poppet valve body 52 is free to undergo reciprocating motion, and which opens and closes a fuel injection passage 51*b*, and an urging spring 53 which urges the poppet valve body 52 with a specified urging force so that the fuel injection passage 51*b* is ordinarily blocked. Furthermore, the injection passage 51*b* is demarcated by a tubular guide part 51*b* which guides the poppet valve body 52 in the direction of the reciprocating motion.

Furthermore, the injection nozzle 50 comprises an outside cylindrical body 54 which is fit over the cylindrical body 51 so that the outside cylindrical body 54 surrounds the outside of the cylindrical body 51. The outside cylindrical body 54 includes an attachment part 54*a* which is used to attach the outlet orifice nozzle 70, an attachment part 54*b* which is used to attach an assist air orifice nozzle 55 that allows the passage of air that assists in the atomization of the injected fuel, and an injection port 54*c* located in the tip end portion of the outside cylindrical body 54.

Furthermore, an annular space with a specified gap is formed between the inside wall of the outside cylindrical body 54 and the outside wall of the cylindrical body 51, and this annular space and a passage inside the attachment part 54*b* that communicates with this annular space form an assist air passage 54*d* that allows the passage of assist air.

A female screw part 51*a* is formed in the upper-end region of the above-mentioned cylindrical body 51, and the inlet orifice nozzle 60 is joined to the female screw part 51*a*' by screw engagement. As is shown in FIG. 3, a passage 61 that allows the passage of fuel that is pressure-fed from the plunger pump 30 is formed in the inlet orifice nozzle 60 (metering jet); furthermore, a portion of the passage 61 is constricted to specified dimensions so that an orifice part 62 is formed.

Figure 4:
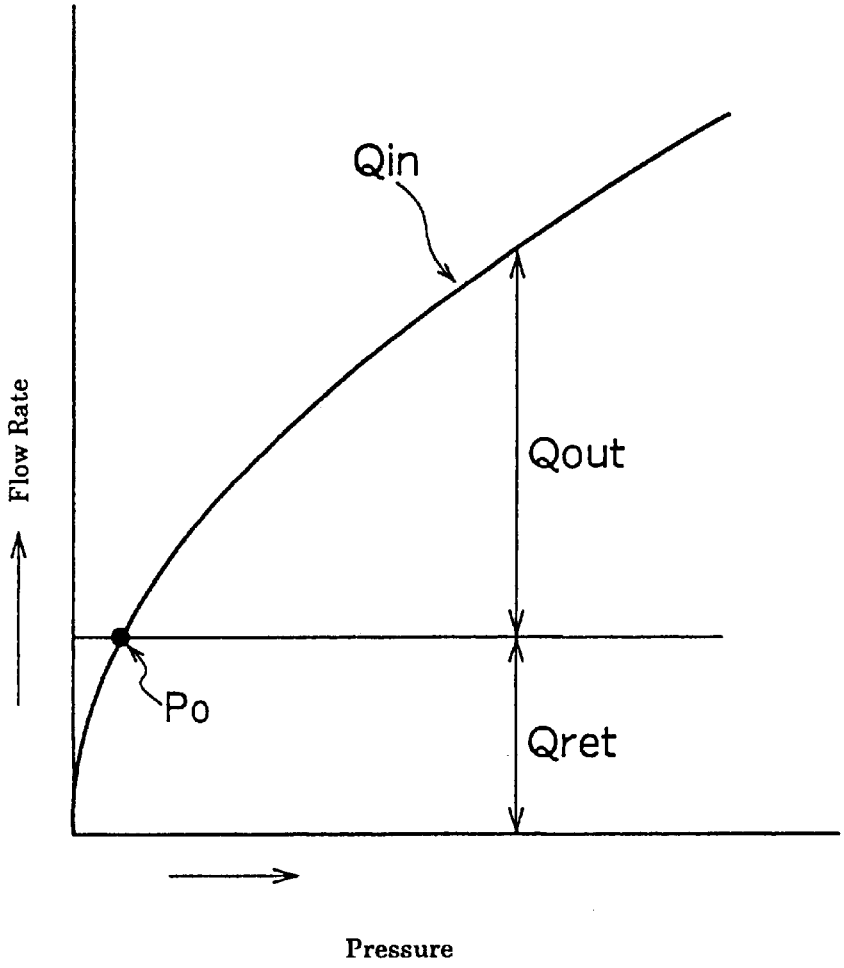
FIG. 4 is a characteristic diagram which shows flow rate characteristics of the inlet orifice nozzle.

The inlet orifice nozzle 60 with the above-mentioned construction detects the flow rate of the fuel passing therethrough by the pressure difference between the upstream and downstream sides thereof. As is shown in FIG. 4, the characteristics of the inlet orifice nozzle 60 are as follows: specifically, in the small-flow-rate region where the flow rate is small, the rate of change in the pressure difference is relatively moderate, i.e., it is nonlinear, while in the large-flow-rate region where the flow rate is large, the rate of change in the pressure difference is sharp, i.e., it has good linearity.

The outlet orifice nozzle 70 is joined by screw engagement to the attachment part 54*a* of the above-mentioned outside cylindrical body 54. As is shown in FIG. 3, a passage 71 that allows the passage of at least some of the fuel that flows into the fuel passage 51*a* of the injection nozzle 50 from the inlet orifice nozzle 60 is formed in the outlet orifice nozzle 70 (circulating jet). Furthermore, a portion of the passage 71 is constricted to specified dimensions so that an orifice part 72 is formed.

The outlet orifice nozzle 70 with the above-mentioned construction acts to apply a bias to the flow rate of the fuel flowing through the inlet orifice nozzle 60 so that the above-mentioned region where the rate of change in the pressure difference of the inlet orifice nozzle 60 is moderate (i.e., the region of strong nonlinearity) is not used. Specifically, as is shown in FIG. 4, in a case where fuel at a flow rate of Qin flows in from the inlet orifice nozzle 60, fuel (return fuel) up to a flow rate of Qret corresponding to the point P0 is caused to flow from the outlet orifice nozzle 70, and is circulated back into the fuel tank 20.

Accordingly, at the stage in which the pressure inside the fuel passage 51*a* exceeds P0, fuel at a flow rate of Qout, which corresponds to the difference between the flow rate Qin of the fuel flowing in from the inlet orifice nozzle 60 and the flow rate Qret of the fuel flowing out from the outlet orifice nozzle 70, is injected from the injection port 54*c* of the injection nozzle 50 as injected fuel.

Furthermore, the above-mentioned point P0 (origin) can be set at a desired position by appropriately setting the dimensions of the orifice part 72 of the outlet orifice nozzle 70 and the initial urging force of the urging spring 53. In this way, furthermore, the initial injection pressure of the injected fuel can be appropriately set.

To describe the flow of the fuel further with reference to FIG. 3, the fuel that is pressure-fed at a specified pressure from the plunger pump 30 first passes through the inlet orifice nozzle 60, and flows into the fuel passage 51*a* of the injection nozzle 50 at a flow rate of Qin.

Meanwhile, some of the fuel that flows into the fuel passage 51*a* passes through the passage 51*c* formed in the side walls of the cylindrical body 51 and the passage 54*a* formed in the outside cylindrical boded 54, and flows out from the outlet orifice nozzle 70 at a flow rate of Qret, so that this fuel is circulated back into the fuel tank 20.

Here, when the pressure inside the fuel passage 51*a* of the injection nozzle 50 exceeds a specified value P0, the poppet valve body 52 is pushed downward against the urging force of the urging spring 53, so that the fuel passage 51*b* is opened. At the same time, the fuel filling the fuel passage 51*a* passes through the passage around the urging spring 53, and flows into the fuel passage 51*b* via the passage 51*d* formed in the guide part 51*b* and further flows along the outer circumferential surface of the poppet valve body 52 so that this fuel is injected into the intake passage of the engine from the injection port 54*c*.

Furthermore, the air that is conducted from the air cleaner is caused to pass through the assist air orifice nozzle (assist air jet) 55 by the negative suction pressure inside the intake passage 21*a,* and is thus conducted into the assist air passage 54*d;* this air is further caused to jet from the injection port 54*c.* In this case, the jetting assist air agitates the injected fuel, so that an atomization similar to that of a carburetor is realized.

In the fuel supply system consisting of the above-mentioned plunger pump 30, inlet orifice nozzle 60, injection nozzle 50 and outlet orifice nozzle 70, the fuel (return fuel) that is caused to flow out from the outlet orifice nozzle 70 is set as the bias amount of the inlet orifice nozzle 60. Accordingly, a relatively small amount is sufficient, and as a result, the plunger pump 30 need not be a large-capacity pump.

Accordingly, power consumption can be reduced; furthermore, the vapor that is generated especially at high temperatures in the fuel that flows out from the outlet orifice nozzle 70 can be positively expelled. As a result, the fuel injection characteristics at high temperatures can be improved.

Figure 5:
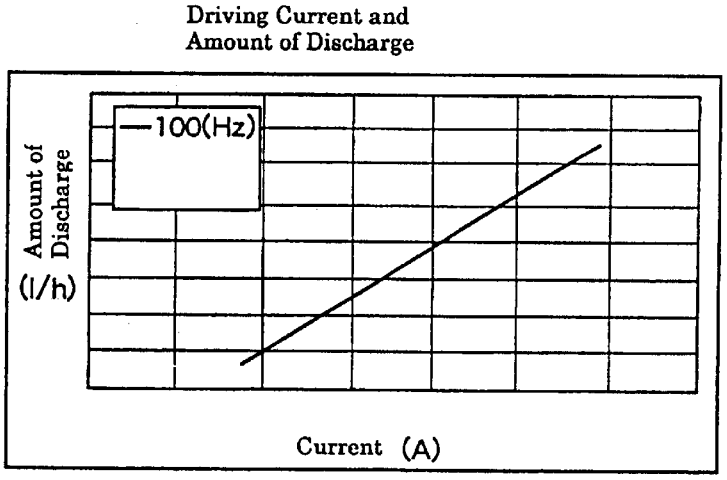
FIG. 5 is a diagram which shows the characteristics of a discharge amount relative to a driving current of the electronically controlled fuel injection device.

Here, the characteristics shown in FIG. 5 are obtained as one example of the flow rate characteristics in the fuel supply system having the above-mentioned construction. FIG. 5 shows the relationship of the amount of discharge to the driving current in a case where the driving current is set at (for example) 100 Hz in the constant-voltage falling-pulse driving of the plunger pump 30.

As is clear from FIG. 5, the relationship between the amount of discharge and the driving current that powers the solenoid coil 33 shows good linear proportionality. Accordingly, a desired injection flow rate Qout can be obtained by appropriately setting the value of the driving current.

Figure 6A:
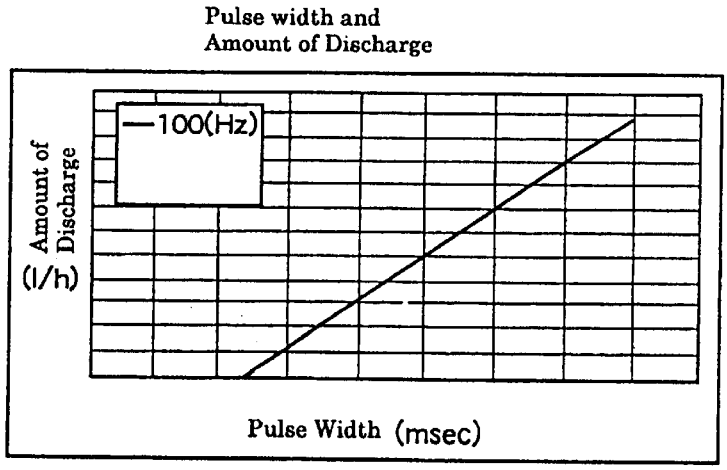
FIGS. 6(*a*) and 6(*b*) show the characteristics of the discharge amount relative to a control pulse width of the electronically controlled fuel injection device, FIG. 6(*a*) being a characteristic diagram showing the discharge amount per unit time, and FIG. 6(*b*) being a characteristic diagram showing the discharge amount per shot.
Figure 6B:
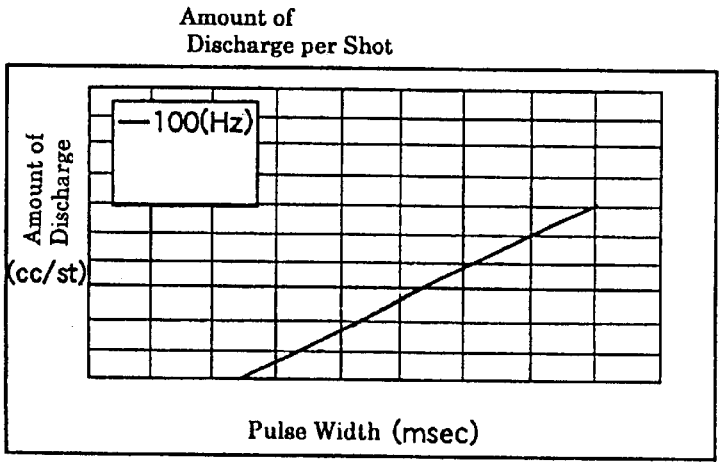

Furthermore, the characteristics shown in FIGS. 6(*a*) and 6(*b*) are obtained as one example of the characteristics of the injection flow rate Qout in a case where the pulse width (msec) used in the pulse driving of the plunger pump 30 is varied. Here, FIG. 6(*a*) shows the amount of discharge per unit time (1/h) in a case where the driving frequency is 100 Hz, and FIG. 6(*b*) shows the amount of discharge per shot (cc/st) in a case where the driving frequency is 100 Hz.

As is clear from FIGS. 6(*a*) and 6(*b*), the relationship between the pulse width and amount of discharge shows good linear proportionality. Accordingly, a desired injection flow rate Qout can be obtained by appropriately setting the pulse width, i.e., the powering time, and the current value. Consequently, the injection flow rate can be controlled as necessary.

FIGS. 7 through 10 illustrate another embodiment of the electronically controlled fuel injection device of the present invention. In this embodiment, the above-mentioned plunger pump and injection nozzle are joined into an integral unit, so that these parts can be handled as a single module; furthermore, adjustment means for adjusting the valve opening pressure (relief pressure) of the injection nozzle are provided.

Figure 8:
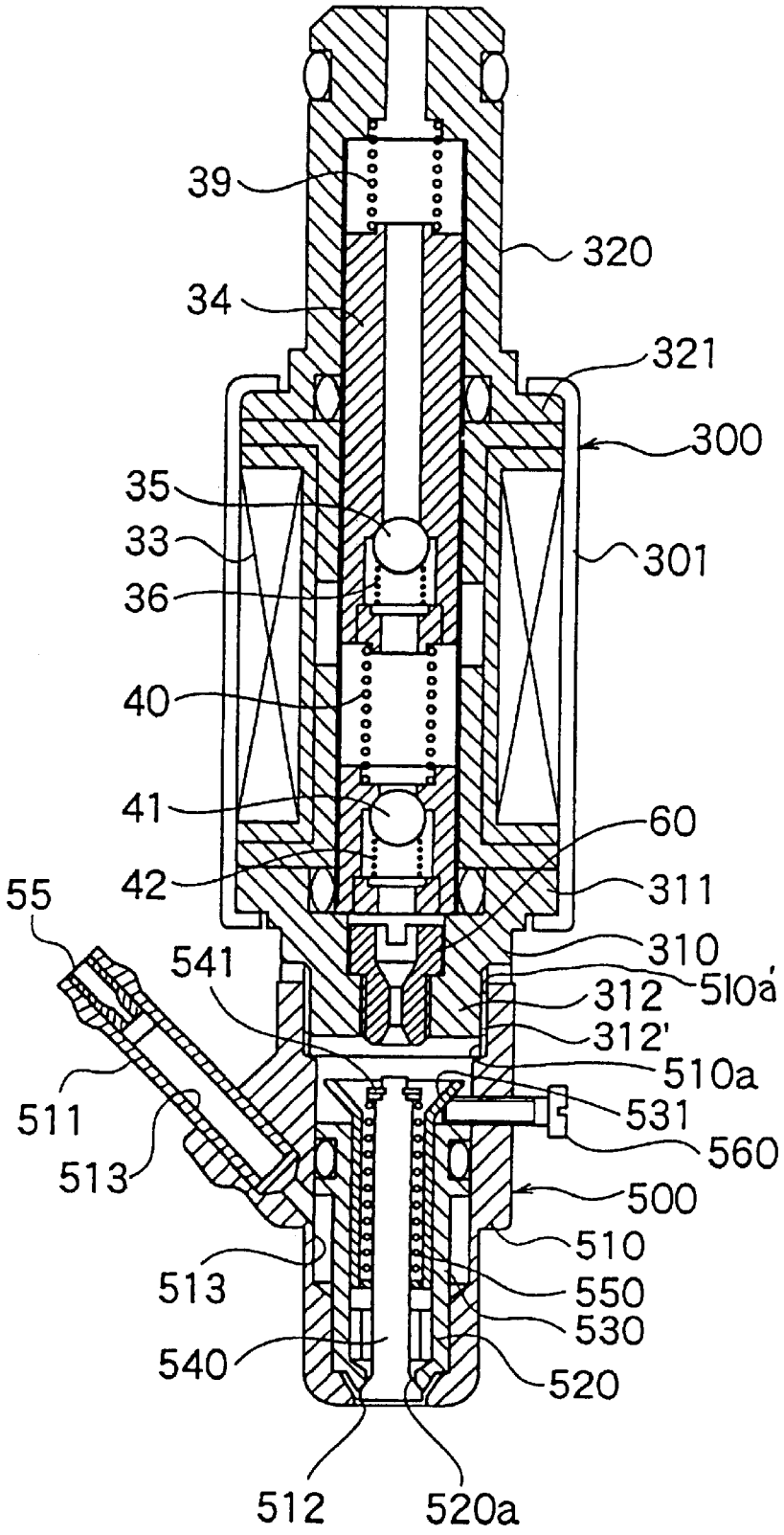
FIG. 8 is a sectional view of the plunger pump and injection nozzle shown in FIG. 7.

Specifically, in the plunger pump 300, as is shown in FIG. 8, a spacer 310 is installed instead of the outside core 47 and outlet pipe 48 that form the above-mentioned plunger pump 30. An inlet orifice nozzle 60 is attached to the internal passage of the spacer 310; one end portion 311 of the spacer 310 is fastened to a pump main body 301, and a female screw part 312 is formed in the other end portion 312. Furthermore, a long outside core 320 is installed instead of the outside core 44 and inlet pipe 45 that form the above-mentioned plunger pump 30, and one end portion 321 of the outside core 320 is fastened to the pump main body 301.

Furthermore, as is shown in FIG. 8, the injection nozzle 500 comprises a cylindrical body 510 which demarcates a fuel passage 510*a,* a tubular guide member 520 which is disposed inside the cylindrical body 510, a tubular retaining member 530 which is inserted into the guide member 520 so that the tubular retaining member 530 is free to undergo reciprocating motion, a poppet valve body 540 which is disposed inside the retaining member 530 so that the poppet valve body 540 is free to undergo reciprocating motion, and which opens and closes the fuel injection passage 520*a,* and an urging spring 550 which is held in the retaining member 530 and urges the poppet valve body 540 with a specified urging force so that the injection passage 520*a* is ordinarily blocked. Moreover, the urging spring 550 contacts a stopper 541 that is attached to the upper end portion of the poppet valve body 540, so that the upward movement of the urging spring 550 is restricted.

Figure 7:
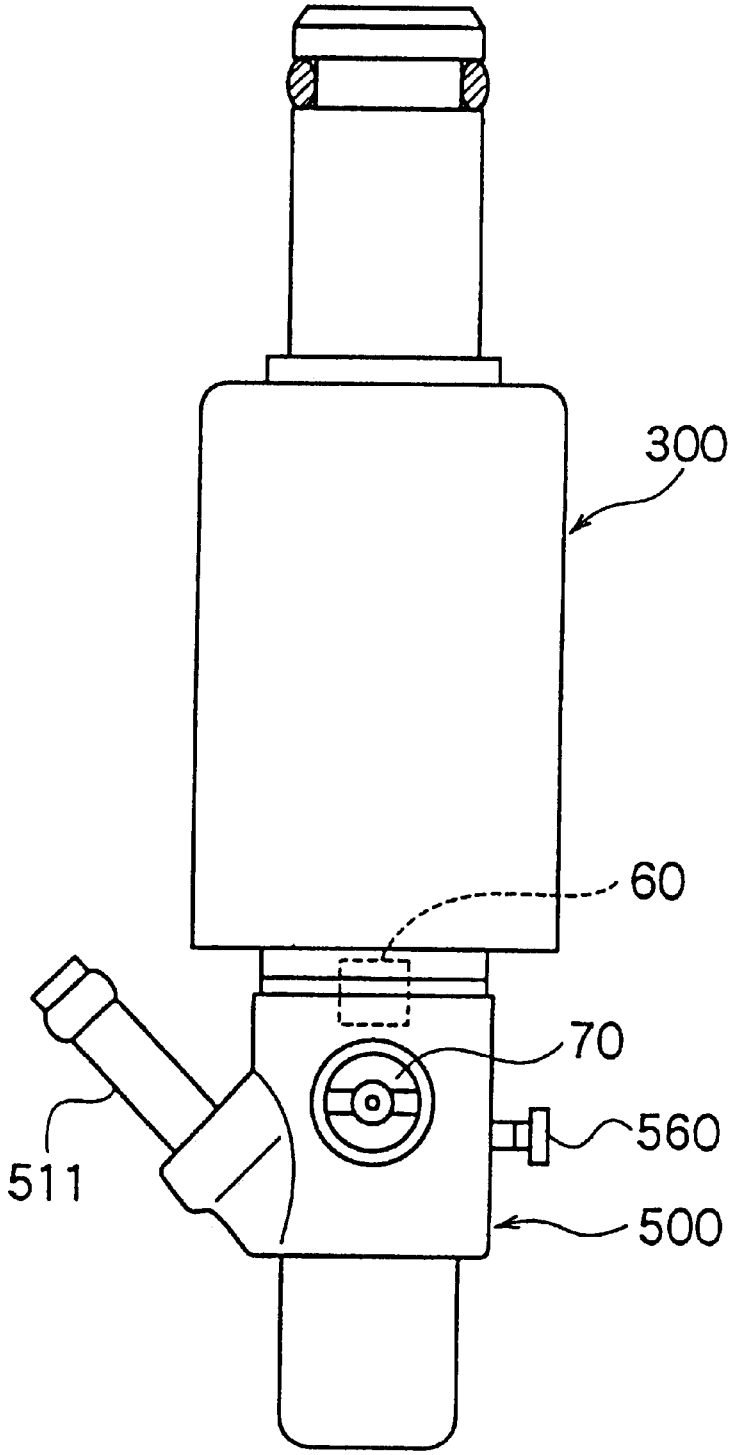
FIG. 7 is a schematic diagram illustrating an embodiment in which the plunger pump and injection nozzle that constitute parts of the electronically controlled fuel injection device are constructed as an integral unit.
Figure 9:
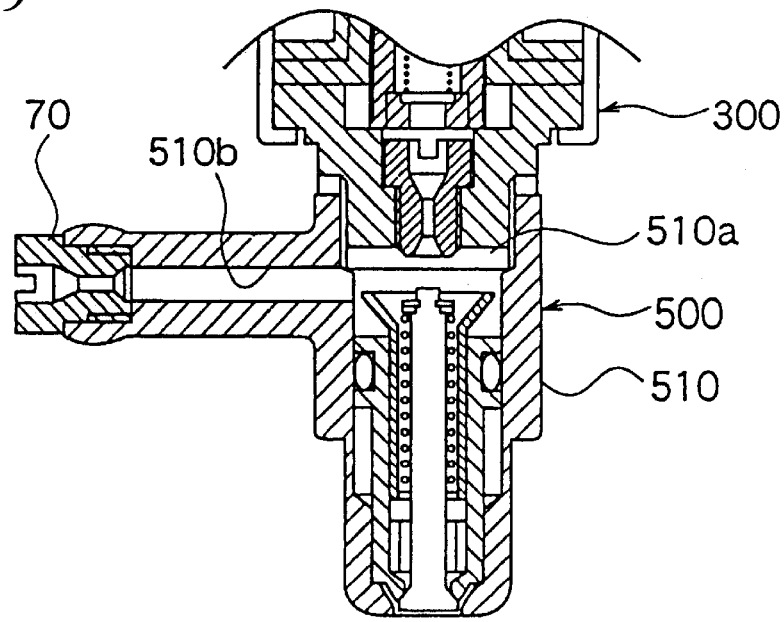
FIG. 9 is a partial sectional view of the plunger pump and injection nozzle shown in FIG. 7.

Furthermore, as is shown in FIG. 9, a passage 510*b* which communicates with the fuel passage 510*a* is formed in the outer circumferential portion of the cylindrical body 510, and as is shown in FIGS. 7 and 9, an outlet orifice nozzle 70 is joined to the outside region of the passage 510*b* by screw engagement. Furthermore, as is shown in FIGS. 7 and 8, a pipe 511 to which the assist air orifice nozzle 55 that allows the passage of assist air that assists in the atomization of the injected fuel is attached is press-fitted in the outer circumferential part of the cylindrical body 510, and an injection port 512 is formed in the tip end portion of the cylindrical body 510.

Furthermore, an annular space with a specified gap is formed between the inside wall of the cylindrical body 510 and the outside wall of the guide member 520, and this annular space and a passage inside the pipe 511 that communicates with this space form an assist air passage 513 that allows the passage of assist air.

As is shown in FIG. 8, a female screw part 510*a* is formed in the upper end region of the above-mentioned cylindrical body 510, and the other end portion 312 of the spacer 310 of the above-mentioned plunger pump 300 is screw-engaged with the female screw part 510*a* so that the plunger pump 300 and injection nozzle 500 are joined into an integral unit.

As a result, both of these parts can be handled as a single module, so that the attachment work is correspondingly reduced; furthermore, the convenience of handling is increased. Furthermore, as is shown in FIG. 7, the module formed by the integration of the plunger pump 300 and injection nozzle 500 may be formed with a configuration similar to that of a conventional electromagnetic valve type injector 3, and the external dimensions may be set so that these dimensions are more or less comparable to those of a conventional electromagnetic valve type injector 3. Accordingly, as a result of such modularization, an integration of parts equivalent to the elimination of a conventional fuel pump 5 can be accomplished.

Figure 10:
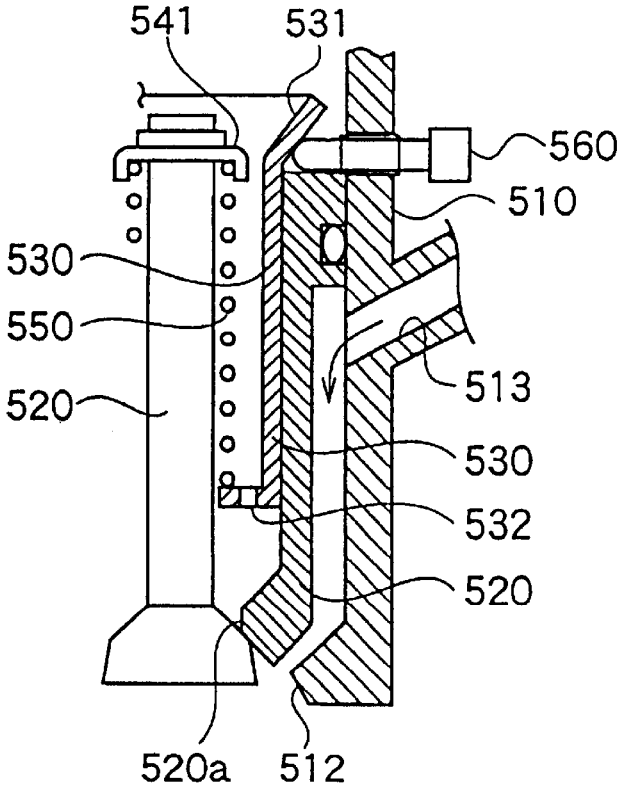
FIG. 10 is a partial sectional view showing an adjustment mechanism used in the embodiment shown in FIG. 7.

As is shown in FIGS. 8 and 10, an inclined part 531 which opens in the form of a funnel (i.e. an outwardly flared part) is formed in the upper portion of the retaining member 530, and a hole 532 that permits the passage of fuel is formed in the bottom portion of the retaining member 530 that holds the urging spring 550. Furthermore, the tip end portion of an adjustment screw 560 that is screwed into the side wall of the cylindrical body 510 contacts the inclined part 531.

Accordingly, when the adjustment screw 560 is screwed in, the retaining member 530 is lifted upward, so that the urging spring 550 is further compressed. As a result, the valve opening pressure of the poppet valve body 540 is set at a higher value. On the other hand, when the adjustment screw 560 is turned in the opposite direction and retracted, the retaining member 530 is pushed downward by the urging force of the urging spring 550, so that the urging spring 550 expands by a corresponding amount. As a result, the valve opening pressure of the poppet valve body 540 is set at a lower value.

Adjustment means for adjusting the urging force of the urging spring 530, i.e., the valve opening pressure (relief pressure), are formed by the above-mentioned adjustment screw 560 and retaining member 530.

As a result of the provision of such adjustment means, the valve opening pressure (relief pressure) can be adjusted even after the injection nozzle 500 is assembled; accordingly, this pressure can be set at various values as necessary, which is convenient from the standpoint of quality control.

Figure 11:
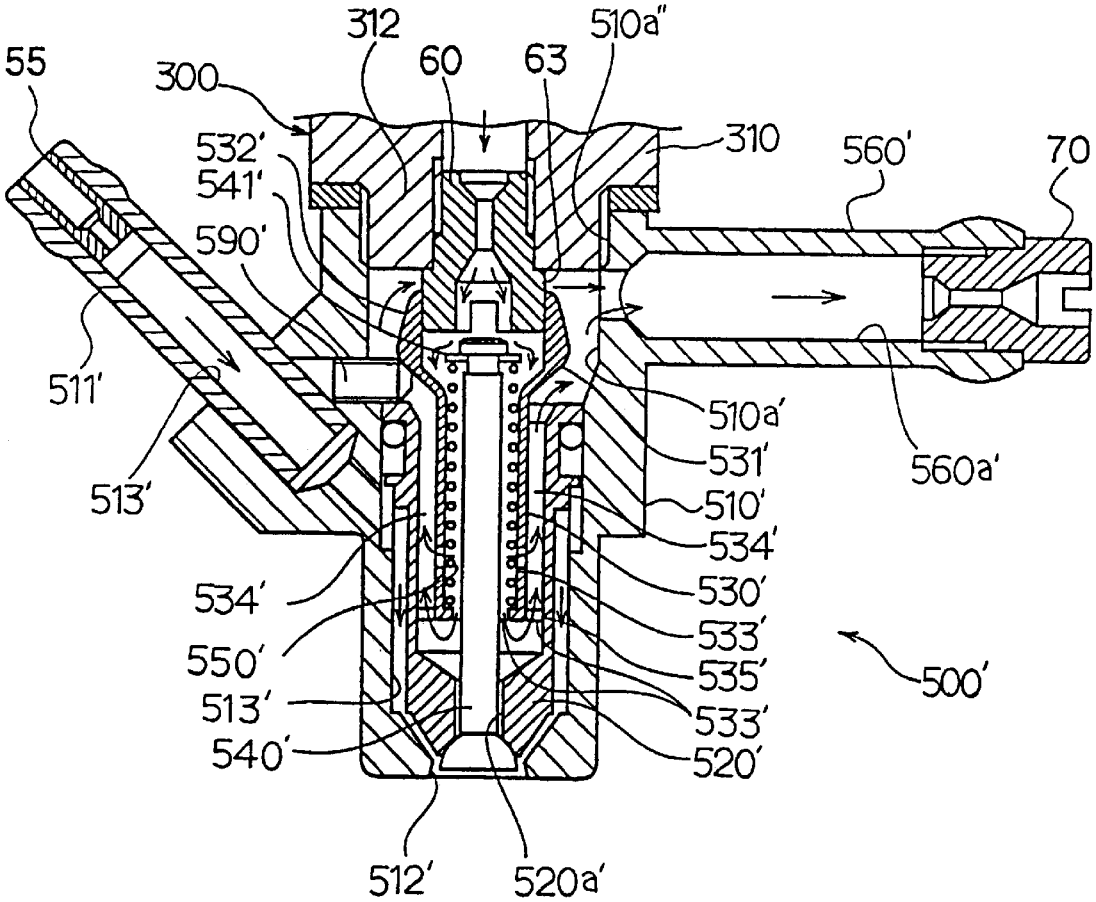
FIG. 11 is a sectional view showing another embodiment of the injection nozzle.

FIG. 11 shows an alteration of the fuel path in the injection nozzle 500 of the electronically controlled fuel injection device shown in FIGS. 7 through 10. As is shown in FIG. 11, the injection nozzle 500 of this embodiment comprises a cylindrical body 510 which demarcates a fuel passage 510*a* a tubular guide member 520 which is disposed inside the cylindrical body 510 a tubular retaining member 530 whose outer circumferential rim part at the lower end is guided by contact with the inside wall of the guide member 520', and which is inserted so that an annular gap is left around the tubular retaining member 530 a poppet valve body 540 which is disposed inside the retaining member 530 so that the poppet valve body 540 is free to undergo reciprocating motion, and which opens and closes the fuel injection passage 520*a* and an urging spring 550 which is held in the retaining member 530 and which urges the poppet valve body 540 with a specified urging force so that the injection passage 520*a* is ordinarily blocked. Furthermore, the urging spring 550 contacts a stopper 541 attached to the upper end portion of the poppet valve body 540 so that the upward movement of the urging spring 550 is restricted.

As is shown in FIG. 11, an outlet pipe 560 which demarcates a fuel return passage 560*a* that communicates with the fuel passage 510*a* is formed as an integral part of the cylindrical body 510 at the outer circumferential portion of the cylindrical body 510 and the outlet orifice nozzle 70 is joined by screw engagement to the outside region of the outlet pipe 560.

Furthermore, as is shown in FIG. 11, a pipe 511 to which the assist air orifice nozzle 55 that allows the passage of assist air that assists in the atomization of the injected fuel is attached is press-fitted in the outer circumferential part of the cylindrical body 510 and an injection port 512 is formed in the tip end portion of the cylindrical body 510.

An annular space with a specified gap is formed between the inside wall of the cylindrical body 510 and the outside wall of the guide member 520 and this annular space and a passage inside the pipe 511 that communicates with this space form an assist air passage 513 that allows the passage of assist air.

A female screw part 510*a* is formed in the upper end region of the above-mentioned cylindrical body 510 and the other end portion 312 of the spacer 310 of the above-mentioned plunger pump 300 is screw-engaged with the female screw part 510*a,* so that the plunger pump 300 and injection nozzle 500 are joined into an integral unit with a sealing member interposed.

As is shown in FIG. 11, an inclined part 531 which opens in the form of a funnel, and a cylindrical part 532 which communicates with the inclined part 531 are formed in the upper portion of the retaining member 530. The outer circumferential part 63 of the inlet orifice nozzle 60 is engaged with the cylindrical part 532 so that the fuel that flows out from the inlet orifice nozzle 60 flows directly into the interior of the retaining member 530 before flowing into the fuel passage 510*a*.

Furthermore, holes 533 which allow the passage of fuel are formed in the bottom portion and one part of the side wall of the retaining member 530. Accordingly, the fuel that is conducted to the upper end of the retaining member 530 from the plunger pump 300 via the inlet orifice nozzle 60 passes through the interior of the retaining member 530 and is conducted to the tip end of the poppet valve body 540. Then, this fuel is injected from the injection port 512 as necessary, and is positively conducted upward via an annular return passage 534 that is formed between the outside wall of the retaining member 530 and the inside wall of the guide member 520 and discharged into the outlet pipe 560.

As a result of using such a spill-back type injection nozzle, the flow of fuel runs in one direction. Accordingly, even if vapor is generated on the tip end side of the poppet valve body 540 or even if vapor is entrained on the tip end side of the poppet valve body 540 this vapor does not accumulate, but is efficiently expelled via the annular return passage 534 along with the flow of the fuel or as a result of the rise of the vapor itself. Furthermore, since a fuel passage is formed as far as the tip end side of the injection nozzle 500 the cooling effect of the fuel is increased, so that the high-temperature characteristics in particular are improved.

The tip end portion of an adjustment screw 590 which is screwed into the side wall of the cylindrical body 510 is caused to contact the inclined part 531. Accordingly, when the adjustment screw 590 is screwed in, the outer circumferential rim portion 535 of the retaining member 530 is guided by the inside wall surface of the guide member 520 and the retaining member 530 is lifted upward, so that the urging spring 550 is further compressed. As a result, the valve opening pressure of the poppet valve body 540 is set at a higher value. On the other hand, when the adjustment screw 590 is turned in the opposite direction and retracted, the retaining member 530 is pushed downward by the urging force of the urging spring 550 so that the urging spring 550 expands by a corresponding amount. As a result, the valve opening pressure of the poppet valve body 540 is set at a lower value.

Adjustment means for adjusting the urging force of the urging spring 550 i.e., the valve opening pressure (relief pressure) are formed by the above-mentioned adjustment screw 590 and retaining member 530. As a result of the provision of such adjustment means, an effect similar to that described above is obtained.

Figure 12:
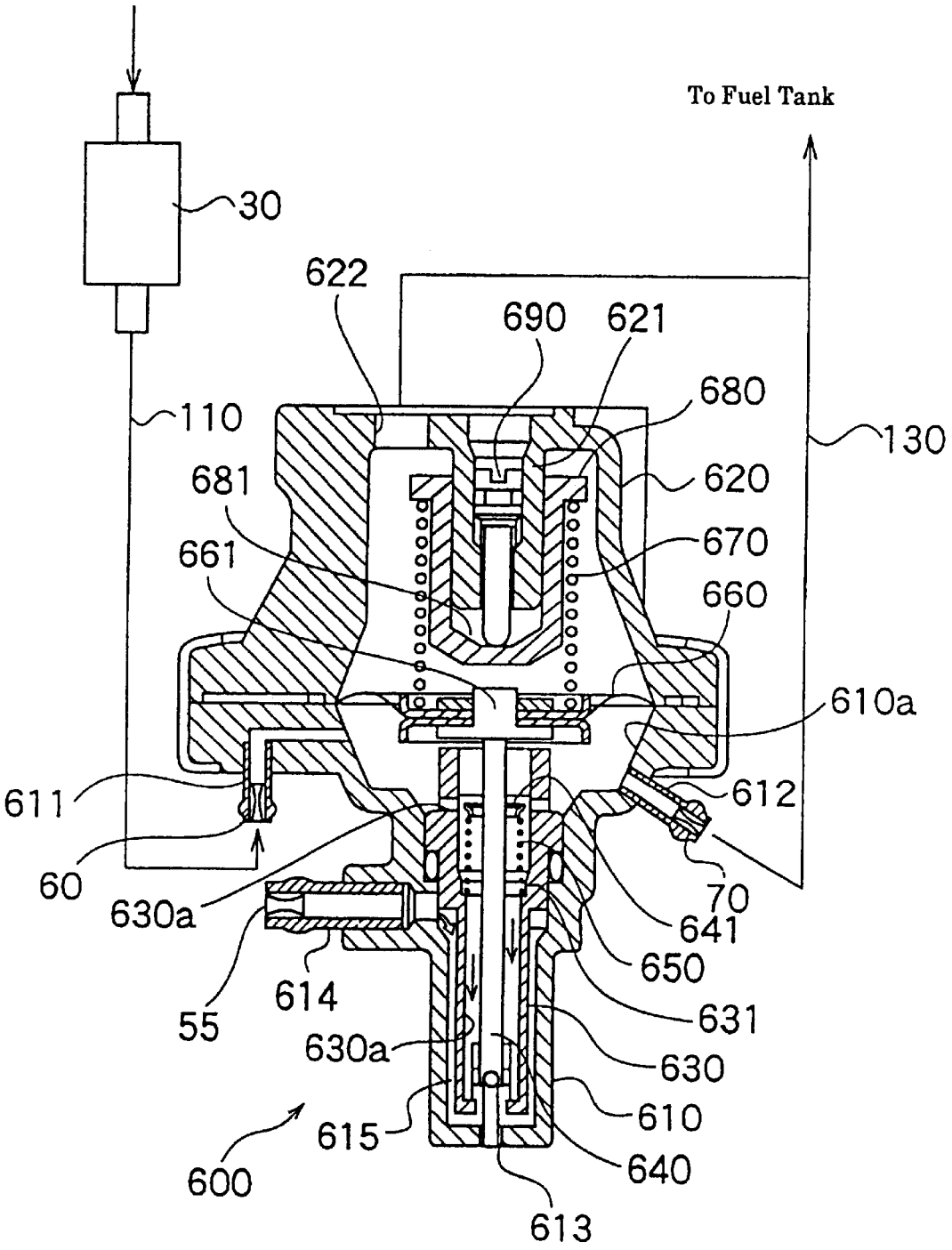
FIG. 12 is a sectional view showing another embodiment of the injection nozzle.

FIG. 12 shows another embodiment of the first electronically controlled fuel injection device of the present invention. In this embodiment, a diaphragm type injection nozzle 600 is used instead of the poppet valve type injection nozzles 50 and 500 described above.

As is shown in FIG. 12, the injection nozzle 600 of this embodiment comprises a lower-side half-body 610 and an upper-side half-body 620 that form an outer contour, a tubular member 630 that is mounted inside the lower-side half-body 610, a valve body 640 that is disposed inside the tubular member 630 so that the valve body 640 is free to undergo reciprocating motion, a coil spring 650 which urges the valve body 640 upward, a diaphragm 660 which is clamped in the region of the joining surfaces of the two half-bodies 610 and 620, an urging spring 670 which is disposed on the diaphragm 660 and which urges the valve body 640 downward, a bottom-equipped sleeve 680 which is fit over a columnar projection 621 on the upper-side half-body 620 so that the sleeve 680 is free to undergo reciprocating motion, and which regulates the urging spring 670 by pressing against the urging spring 670 from above, and an adjustment screw 690 which is screwed into the upper-side half-body 620 so that the adjustment screw 690 contacts a bottom part 681 of the bottom-equipped sleeve 680.

A space is formed in the upper part of the lower-side half-body 610, and this space is blocked by the diaphragm 660 so that a control chamber 610*a* is formed. An inlet pipe 611 and an outlet pipe 612 are press-fitted into holes formed in the lower-side half-body 610 so that these pipes communicate with the control chamber 610*a*. Furthermore, an inlet orifice nozzle 60 is attached to the inlet pipe 611, and an outlet orifice nozzle 70 is attached to the outlet pipe 612. Furthermore, the tip end portion of the lower-side half-body 610 is formed so that the lower-side half-body 610 has a bottom, and an injection port 613 is formed substantially in the central portion of this bottom.

A fuel passage 630*a* which communicates with the control chamber 610*a* is formed in the tubular member 630, and a step part 631 is formed substantially in a vertically central portion of the fuel passage 630*a*. The lower end of the coil spring 650 is seated on the step part 631.

An annular space with a specified gap is formed between the outer circumferential surface of the above-mentioned tubular member 630 and the inner circumferential surface of the lower-side half-body 610, and an assist air introduction pipe 614 to which an assist air orifice nozzle 55 is attached is press-fitted in a hole formed in the side wall of the lower-side half-body 610 so that the assist air introduction pipe 614 communicates with the above-mentioned annular space. Specifically, the annular space and a passage formed through the assist air introduction pipe 614 form an assist air passage 615 which allows the passage of assist air.

The valve body 640 has a rod shape that is elongated in the vertical direction. An engaging part 641 is fastened to the upper region of the valve body 640, and the upper end of the coil spring 650 is engaged with the engaging part 641. Furthermore, a lower end portion of the valve body 640 is formed so that this lower end portion opens and closes the fuel passage 630*a*. Specifically, at the point in time when the valve body 640 moves downward and makes contact, the fuel passage 630*a* is blocked, and at the point in time when the valve body 640 moves upward and achieves separation, the fuel passage 630*a* is opened.

The diaphragm 660 has a contact part 661 that is located substantially in the central portion of the diaphragm 660. The contact part 661 contacts the upper end of the valve body 640. Furthermore, the diaphragm 660 is pushed downward by the urging force of the urging spring 670, so that the contact part 661 is ordinarily engaged with the upper end of the valve body 640.

A space which accommodates the above-mentioned urging spring 670 and bottom-equipped sleeve 680 is formed in the upper-side half-body 620, and this space communicates with an intermediate point of the fuel return pipe 130 connected to the outlet pipe 612, via a passage 622 formed in the side wall.

Here, to describe the operation of the above-mentioned injection nozzle 600, the fuel that is pressure-fed at a specified pressure from the plunger pump 30 first passes through the inlet orifice nozzle 60, and flows into the control chamber 610*a* at a flow rate of Qin.

Meanwhile, some of the fuel that flows into the control chamber 610*a* passes through the outlet pipe 612 and flows out of the outlet orifice nozzle 70 at a flow rate of Qret, so that this fuel is circulated back into the fuel tank 20.

Then, when the pressure inside the control chamber 610*a* exceeds a specified value P0, the diaphragm 660 is pushed upward against the urging force of the urging spring 670, and the valve body 640 is correspondingly lifted upward by the urging force of the coil spring 650, so that the fuel passage 630*a* is opened. At the same time, the fuel filling the fuel passage 630*a* is injected into the intake passage of the engine from the injection port 613.

Furthermore, the air that is conducted from the air cleaner is caused to pass through the assist air orifice nozzle (assist air jet) 55 by the negative suction pressure inside the intake passage 21*a* of the intake manifold 21 (FIG. 1), and is thus conducted into the assist air passage 615; this air is further caused to jet from the injection port 613. In this case, this jetting assist air agitates the injected fuel, so that an atomization similar to that of a carburetor is realized.

Figure 13:
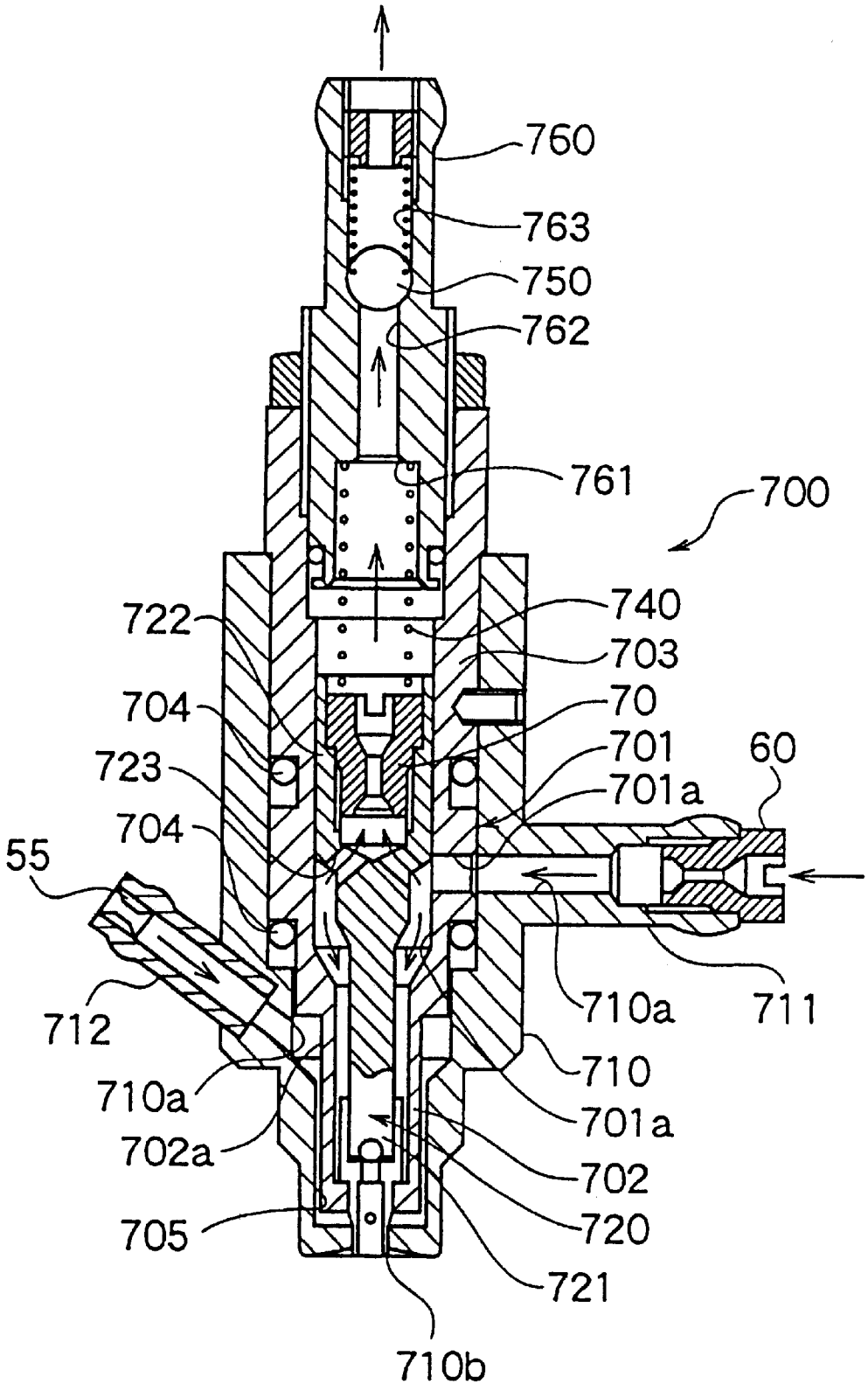
FIG. 13 is a sectional view showing another embodiment of the injection nozzle.

FIG. 13 shows another embodiment of the first electronically controlled fuel injection device of the present invention. In this embodiment, the diaphragm type injection nozzle 600 shown in the above-mentioned FIG. 12 is further altered.

As is shown in FIG. 13, the injection nozzle 700 of this embodiment comprises an inside tubular member 701 and an outside tubular member 710 comprising cylindrical bodies which demarcate fuel passages 701*a* and 710*a* that communicate with an inlet orifice nozzle 60 and an outlet orifice nozzle 70, a valve body 720 which is disposed inside the tubular member 701 so that the valve body 720 is free to undergo reciprocating motion, and which opens and closes the fuel passage 701*a,* an urging spring 740 which urges the valve body 720 with a specified urging force so that the fuel passage 701*a* is ordinarily blocked, and an outlet connector 760 which supports one end of the urging spring 740 and contains a check valve 750.

An inlet pipe 711 which demarcates the fuel passage 710*a* is formed as an integral part of the outside tubular member 710, and the inlet orifice nozzle 60 is connected by screw engagement to the region of the opening part of the inlet pipe 711. Furthermore, an assist air introduction pipe 712 to which an assist air orifice nozzle 55 is attached is press-fitted in one side portion of the outside tubular member 710 and has the fuel passage 710*a* formed therein in communication with the assist air orifice nozzle 55, and an injection port 710*b* that injects fuel is formed in the tip end portion of the outside tubular member 710.

The inside tubular member 701 is formed by a tip-end tubular part 702 with a reduced diameter on the tip end side, and a cylindrical part 703 with an expanded diameter which is integrally connected to the tip-end tubular part 702. Furthermore, the outer circumferential surface of the cylindrical part 703 is tightly engaged with an inside wall of the outside tubular member 710 via an O-ring in a specified position, and an outer circumferential surface 702*a* of the tip-end tubular part 702 is partially disposed at a specified distance from the inside wall of the outside tubular member 710. The space that is demarcated by the outer circumferential surface 702*a* and the inside wall of the outside tubular member 710, and the passage in the assist air introduction pipe 712, form an assist air passage 705 that allows the passage of assist air.

The valve body 720 is formed, with an elongated rod shape having a step, by a valve part 721 which is solid and formed in a columnar shape with a reduced diameter, and a cylindrical part 722 which is formed with an expanded diameter as an integral unit with the valve part 721. A plurality of fuel passages 723 are formed in the connecting part between the valve part 721 that has a reduced diameter and the cylindrical part 722 that has an expanded diameter. Furthermore, the outlet orifice nozzle 70 is connected to the cylindrical part 722 by screw engagement.

Furthermore, the outer circumferential surface of the valve part 721 and the inside wall of the inside tubular member 701 are separated by a gap so that a fuel passage 701*a* is demarcated, and the valve body 720 is inserted in the inside tubular member 701 so that the valve body 720 can undergo reciprocating motion (sliding motion) through the interior of the inside tubular member 701 in a state in which the outer circumferential surface of the cylindrical part 722 is in tight contact with the inside wall of the inside tubular member 701.

Furthermore, the urging spring 740 is disposed inside the inside tubular member 701 in a state in which one end portion of the urging spring 740 is caused to contact the end surface of the outlet orifice nozzle 70 positioned above the valve body 720. Moreover, in this state, the outlet connector 760 is connected by screw engagement to the upper end portion of the inside tubular member 701, so that the other end portion of the urging spring 740 is caused to contact an interior step part 761 of a passage formed in the outlet connector 760. Specifically, the urging spring 740 is compressed by a specified amount so that the valve body 720 is ordinarily urged downward, thus causing the valve part 721 to block the fuel passage 701*a*.

The check valve 750 which is urged by a coil spring 763 is disposed in the outlet connector 760 so that a fuel passage 762 thereof is ordinarily blocked.

Furthermore, the outlet connector 760 is arranged so that the amount by which the outlet connector 760 is screwed into the inside tubular member 701 can be adjusted; as a result, the valve opening pressure of the valve body 720 can be appropriately adjusted by adjusting the amount of compression of the urging spring 740.

Here, to describe the operation of the above-mentioned injection nozzle 700, the fuel that is pressure-fed at a specified pressure from the plunger pump 30 first passes through the inlet orifice nozzle 60, and flows into the fuel passage 701*a* of the inside tubular member 701 at a flow rate of Qin.

Meanwhile, some of the fuel that flows into the fuel passage 701*a* passes through the fuel passages 723, and flows out from the outlet orifice nozzle 70 at a flow rate of Qret. When the pressure of the fuel on the downstream side of the outlet orifice nozzle 70 exceeds a specified value, the check valve 750 opens the fuel passage 762, so that the fuel is circulated back into the fuel tank 20.

Then, when the pressure inside the fuel passage 701 a exceeds a specified value of P0, the valve body 720 is pushed upward against the urging force of the urging spring 740, so that the valve part 721 opens the lower end portion of the fuel passage 701*a*. At the same time, the fuel filling the fuel passage 701*a* is injected into the intake passage 21*a* of the engine intake manifold 21 (FIG. 1)from the injection port 710*b*.

Furthermore, the air that is conducted from the air cleaner is caused to pass through the assist air orifice nozzle (assist air jet) 55 by the negative suction pressure inside the intake passage 21*a,* and is thus conducted into the assist air passage 705; this air is further caused to jet from the injection port 710*b*. In this case, this jetting assist air agitates the injected fuel, so that an atomization similar to that of a carburetor is realized.

In the injection nozzle 700 of this embodiment, the external dimensions can be reduced compared to those of the above-mentioned injection nozzle 600 using a diaphragm, so that installation, layout and the like are facilitated.

Figure 14:
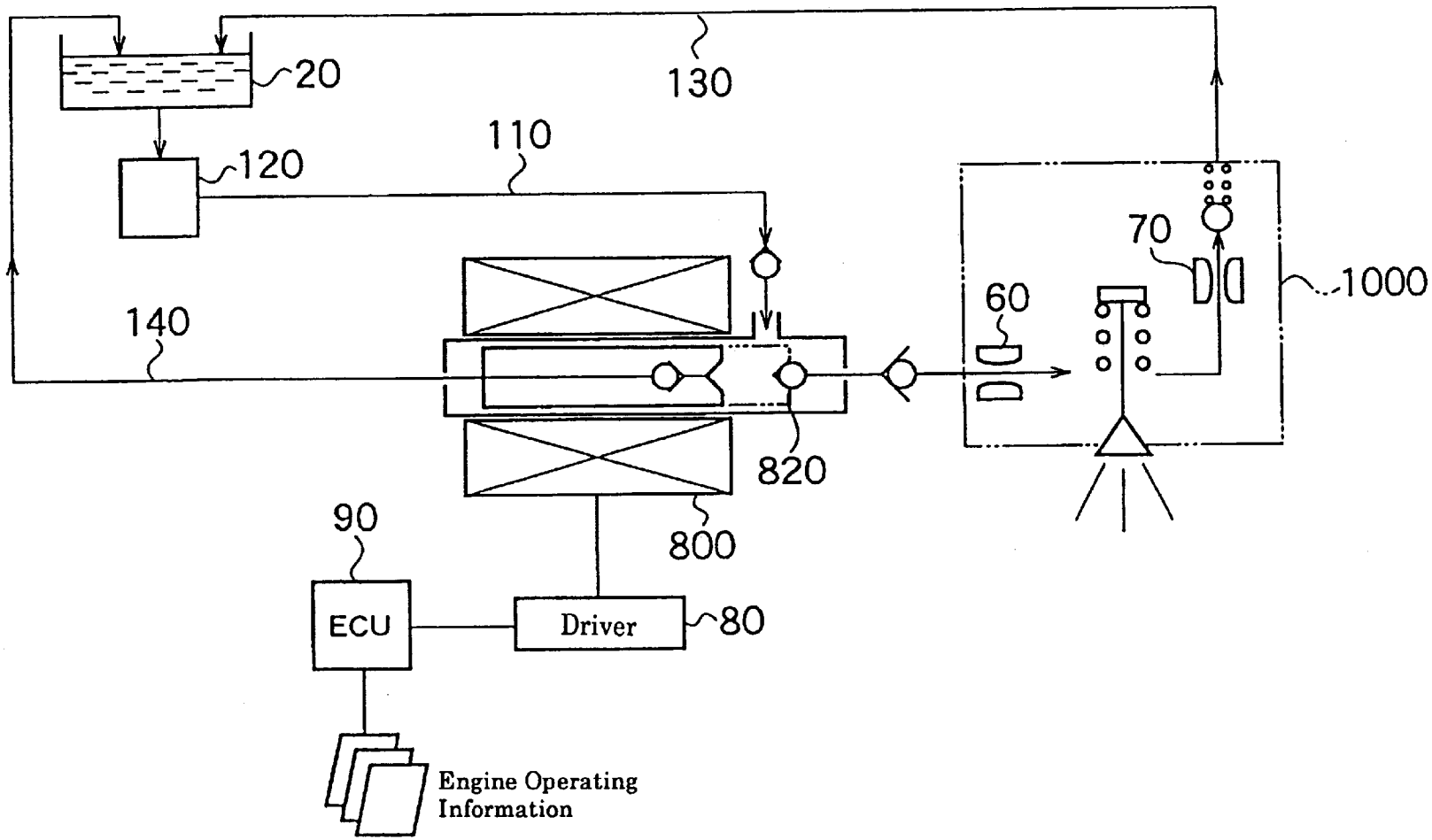
FIG. 14 is a schematic diagram showing one embodiment of a second electronically controlled fuel injection device of the present invention.
Figure 15:
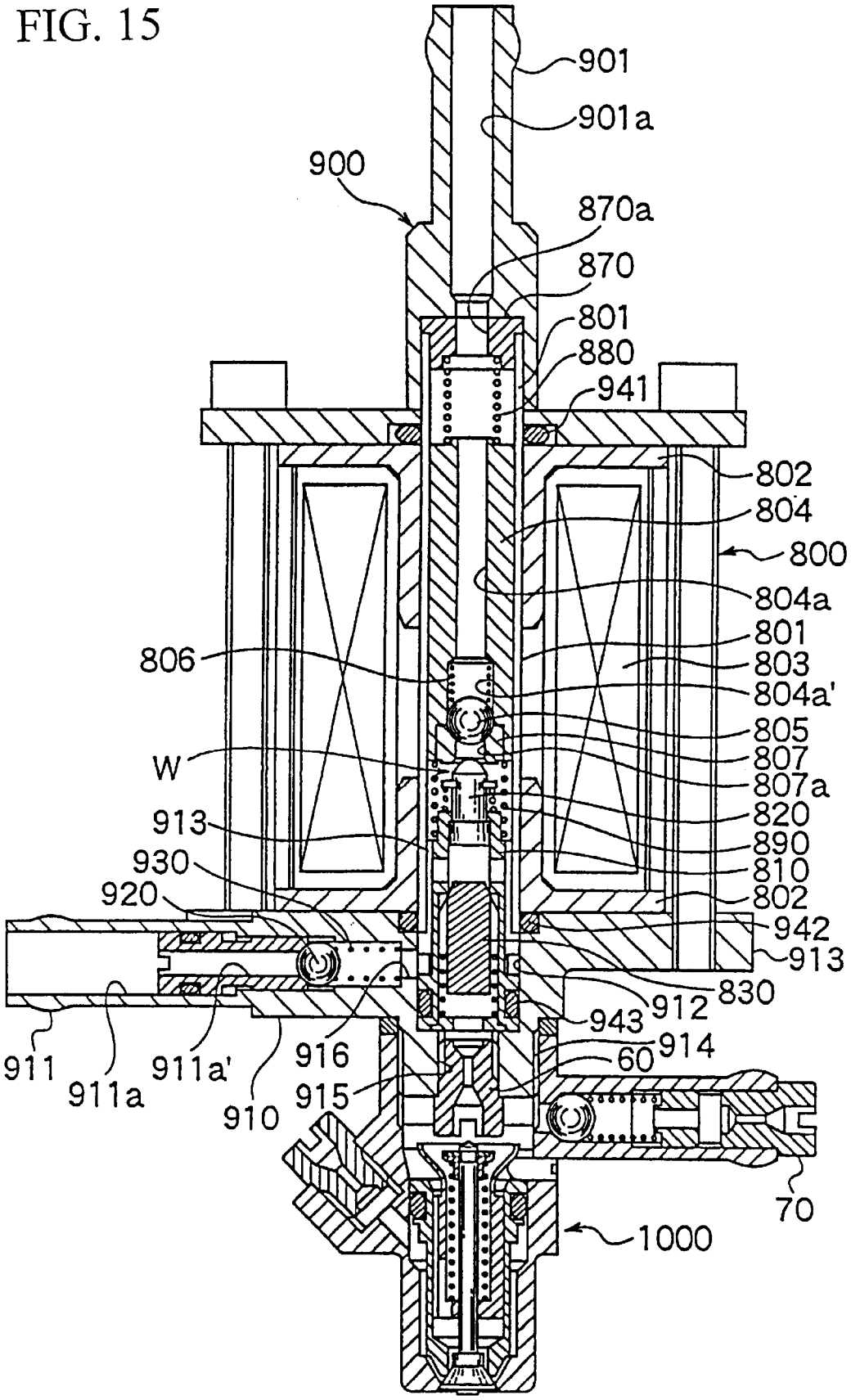
FIG. 15 is a sectional view showing the plunger pump and injection nozzle used in the concrete realization of the system shown in FIG. 14.
Figure 16:
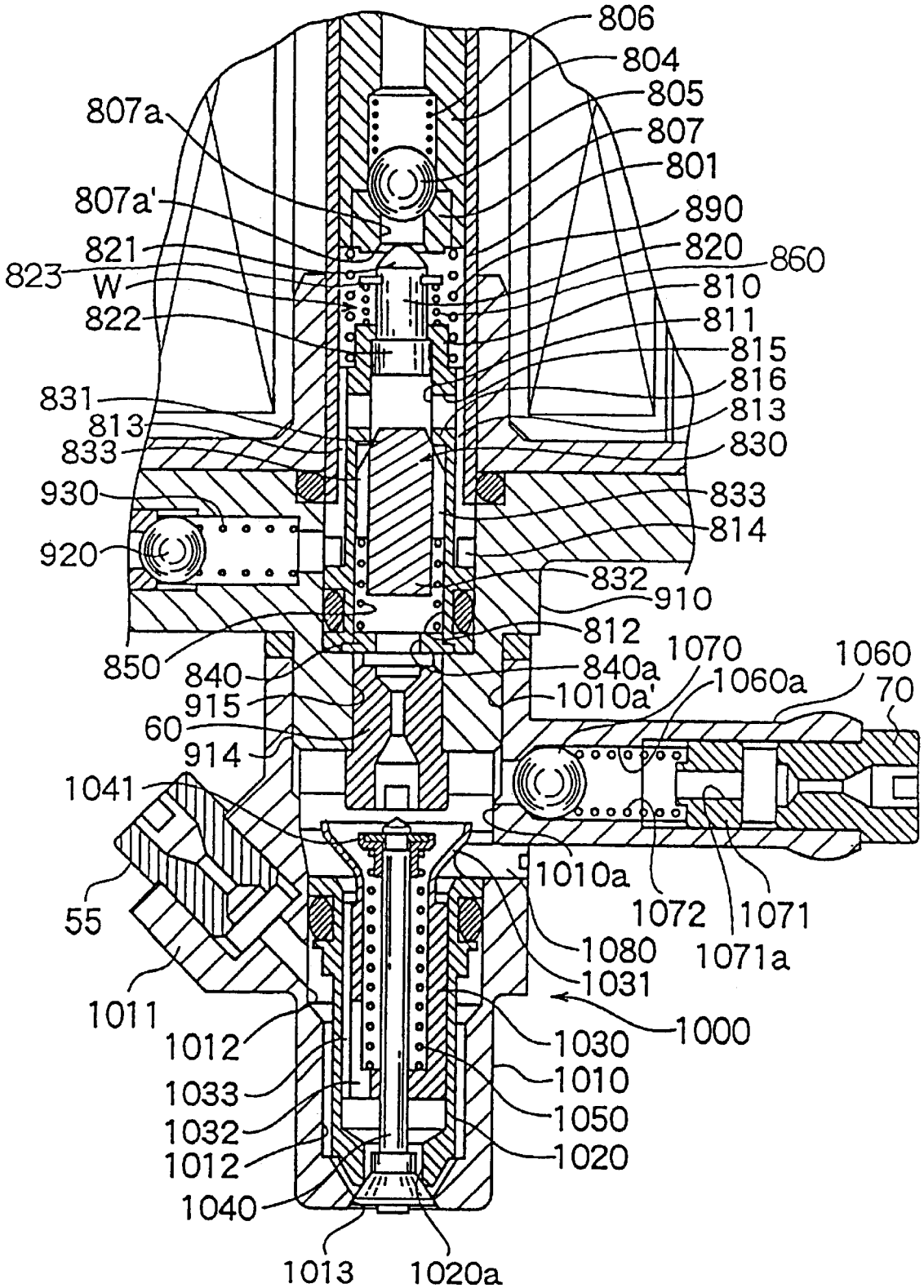
FIG. 16 is a partial enlarged sectional view of the construction shown in FIG. 15.

FIGS. 14 through 16 illustrate an embodiment of a second electronically controlled fuel injection device of the present invention. FIG. 14 is a schematic diagram of the system, FIG. 15 is a sectional view illustrating a case in which the electromagnetically driven pump and injection nozzle are constructed as an integral unit, and FIG. 16 is a partial enlarged sectional view of the same embodiment. As is shown in FIGS. 14 and 15, the electronically controlled fuel injection device of this embodiment comprises as basic constituent elements a plunger pump 800 which is used as an electromagnetically driven pump that pressure-feeds fuel from the fuel tank 20 of a two-wheeled vehicle, a circulation passage 140 which circulates fuel that has been pressurized to a specified pressure or greater in a specified initial stage of the pressure-feeding stroke performed by the plunger pump 800 back into the fuel tank 20, a spill valve 820 which is used as a valve body that blocks the circulation passage in the later stage of the pressure-feeding stroke but not in the initial stage, an inlet orifice nozzle 60 which has an orifice part that allows the passage of fuel that has been pressurized to a specified pressure in the later stage of the pressure-feeding stroke, an outlet orifice nozzle 70 which has an orifice part that allows the passage of fuel in order to circulate a specified amount of the fuel that passes through the inlet orifice nozzle 60 back into the fuel tank 20, an injection nozzle 1000 which injects an amount of fuel equal to the difference between the fuel that has passed through the inlet orifice nozzle 60 and the fuel that has passed through the outlet orifice nozzle 70 into the intake passage of the engine, and a driver 80 and a control unit (ECU) 90 used as control means that send control signals to the plunger pump 800 and the like on the basis of engine operating information.

Here, to describe the plunger pump 800, this fuel pump is an electromagnetically driven positive displacement pump. As is shown in FIGS. 15 and 16, a core 802 is joined to the outer circumference of a cylinder 801 comprising a cylindrical body that has a cylindrical shape, and a solenoid coil 803 is wound around the outer circumference of the core 802. A plunger 804 comprising a movable body that has a specified length is inserted into the cylinder 801 so that the plunger 804 makes tight contact with the cylinder 801, and the plunger 804 is free to undergo reciprocating motion by sliding in the axial direction through the cylinder 801.

As is shown in FIG. 15, a circulation passage 804*a* is formed through the plunger 804 in the direction of the reciprocating motion (axial direction); furthermore, an expanded part 804*a* in which the circulation passage 804*a* is expanded in the radial direction is formed in one end of the plunger 804. Furthermore, a pressurizing valve 805 and a coil spring 806 which urges the pressurizing valve 805 toward the upstream side are disposed inside the expanded part 804*a* and a stopper 807 which forms a part of the plunger 804 and which has a circulation passage 807*a* in the central portion is engaged with the outside end portion of the expanded part 804*a*. One end of the coil spring 806 is held by the end surface of the stopper 807.

As is shown in FIG. 16, a tubular member 810 is fixed by press-fit engagement to the cylinder 801 in a position separated from the plunger 804 so that the tubular member 801 faces the stopper 807, and a fuel passage 811 with a reduced diameter and a fuel passage 812 with an expanded diameter are formed inside the tubular member 810. Furthermore, a plurality of fuel passages 813 that extend in the axial direction, an annular fuel passage 814 that communicates with these fuel passages 813, and a fuel passage 815 that extends in the radial direction so as to communicate with the fuel passage 811 and the fuel passages 813, are formed at the outer circumferential surface of the tubular member 810.

Furthermore, the spill valve 820 used as a valve body is disposed inside the passage 811 that has a reduced diameter, so that the spill valve 820 is free to undergo reciprocating motion, and an outlet check valve 830 is disposed inside the fuel passage 812 that has an expanded diameter, so that this outlet check valve 830 is free to undergo reciprocating motion. Furthermore, a stopper 840 which has a fuel passage 840*a* is fastened by engagement to one end portion of the tubular member 810.

As is shown in FIG. 16, the spill valve 820 is formed by a circular-conical tip end part 821, an expanded-diameter part 822, an annular flange part 823 and the like. The outlet check valve 830 is formed by a tip end part 831 that has a circular-conical surface, a cylindrical part 832 that forms a continuation of the tip end part 831, and a plurality of fuel passages 833 which are formed in the outer circumferential surface and extend in the axial direction.

Furthermore, the outlet check valve 830 is urged by a coil spring 850 so that the tip end part 831 of the outlet check valve 830 blocks an opening part 816 positioned at the end portion of the fuel passage 811. The spill valve 820 is urged by a coil spring 860 disposed between the upper end surface of the tubular member 810 and the flange part 823 so that the tip end part 821 of the spill valve 820 blocks an opening part 807*a* positioned at the end portion of the circulation passage 807*a* formed in the stopper 807.

Furthermore, as is shown in FIG. 15, a supporting member 870 which has a circulation passage 870*a* is mounted in one end portion of the cylinder 801, and a coil spring 880 is disposed between the supporting member 870 and one end portion of the plunger 804. Furthermore, a coil spring 890 is disposed between the other end portion (stopper 807) of the plunger 804 and the tubular member 810. These coil springs 880 and 890 form elastic bodies that drive the plunger 804 in the direction of the reciprocating motion. Furthermore, the space in which the coil spring 890 is disposed is the operating chamber W of the plunger 804.

Furthermore, as is shown in FIG. 15, a connector member 900 and a spacer member 910 are fastened by means of bolts to both ends of the cylinder 801. The connector member 900 is formed by a connector part 901 that demarcates a circulation passage 901*a,* a fastening flange part 902 and the like, and the spacer member 910 is formed by a connector part 911 that demarcates a fuel supply passage 911*a,* an engagement hole 912 in which the tubular member 810 is engaged, a fastening flange part 913, a female screw part 914 which is used for the connection of the injection nozzle 1000, and an internal passage 915 that communicates with the engagement hole 912.

Furthermore, a check valve 920 is disposed in the connector part 911, and the check valve 920 is urged toward the upstream side by a coil spring 930 so that the fuel supply passage 911*a,* 911*a* is normally blocked. Moreover, when the check valve 920 opens, the fuel supply passage 911*a* communicates with the operating chamber W via an opening part 916 and a fuel passage 813. Furthermore, an inlet orifice nozzle 60 is attached to the internal passage 915. Moreover, the connector member 900 and the spacer member 910 are connected to the pump main body via O-rings 941, 942 and 943.

As is shown in FIG. 16, the injection nozzle 1000 comprises a cylindrical body 1010 that demarcates a fuel passage 1010*a,* a tubular guide member 1020 which is disposed inside the cylindrical body 1010, a tubular retaining member 1030 which is inserted into the guide member 1020 so that this retaining member 1030 is free to undergo reciprocating motion, a poppet valve body 1040 which is disposed inside the retaining member 1030 so that the poppet valve body 1040 is free to undergo reciprocating motion, and which opens and closes a fuel injection passage 1020*a,* and an urging spring 1050 which is held in the retaining member 1030, and which urges the poppet valve body 1040 with a specified urging force so that the injection passage 1020*a* is ordinarily blocked. Furthermore, the urging spring 1050 contacts a stopper 1041 that is attached to the upper end portion of the poppet valve body 1041, so that the upward movement of the urging spring 1050 is restricted.

As is shown in FIG. 16, an outlet pipe 1060 which demarcates a fuel return passage 1060*a* that communicates with the fuel passage 1010*a* is formed as an integral unit with the cylindrical body 1010 on the outer circumferential part of the cylindrical body 1010. An outlet orifice nozzle 70 is connected by screw engagement to the outside region of the outlet pipe 1060.

Furthermore, a check valve 1070 used as a back-flow preventing valve that opens and closes the fuel return passage 1060*a* is disposed inside the outlet pipe 1060, and an adjuster 1071 which has a fuel passage 1071*a* is attached by screw engagement to a female screw formed in the inside wall of the outlet pipe 1060. A coil spring 1072 which urges the check valve 1070 so that the check valve 1070 ordinarily blocks the fuel return passage 1060*a* is disposed between the adjuster 1071 and the check valve 1070. The operation of the adjuster 1071 is the same as described above.

Furthermore, as is shown in FIG. 16, a flange part 1011 is formed on the outer circumferential part of the cylindrical body 1010, and an assist air orifice nozzle 55 is screw-engaged with the flange part 1011. Moreover, air that passes through the assist air orifice nozzle 55 passes through an assist air passage 1012, and is caused to jet from an injection port 1013, so that the air assists in the atomization of the injected fuel.

As is shown in FIG. 16, a female screw part 1010*a* is formed in the upper end region of the above-mentioned cylindrical body 1010, and a male screw part 914 on the spacer member 910 positioned at the lower end of the above-mentioned plunger pump 800 is screw-engaged with the female screw part 1010*a* so that the plunger pump 800 and injection nozzle 1000 are joined into an integral unit. As a result, both parts can be handled as a single module as described above, so that the amount of assembly work required can be reduced, the convenience of handling is improved, and the size of the apparatus is reduced.

As is shown in FIG. 16, an inclined part 1031 that opens in the form of a funnel is formed in the upper portion of the retaining member 1030, and fuel passages 1032 and 1033 are formed in the side surface and outer circumferential surface of the bottom portion of the inclined part 1031 that holds the urging spring 1050. Furthermore, the tip end portion of an adjustment screw 1080 that is screwed into the side wall of the cylindrical body 1010 contacts the inclined part 1031. Moreover, the action of the adjustment screw 1080 and inclined part 1031 is the same as described above; accordingly, description thereof is omitted here.

Here, to describe the operation of the plunger pump 800 and injection nozzle 1000, when the plunger 804 moves in one direction (upward in FIG. 15) in the fuel suction stroke, the pressure inside the operating chamber W drops, so that the check valve 920 opens. Then, the fuel that is conducted via the low-pressure filter 120 from the fuel tank 20 passes through the fuel supply passage 911*a,* opening part 916 and fuel passage 813, and is sucked into the operating chamber W.

Meanwhile, while the plunger 804 moves in the other direction (downward in FIG. 15) in the fuel pressure-feeding stroke, the pressurizing valve 805 opens when the fuel that is pressure-fed in the initial stage of this movement exceeds a specified pressure (pressurization), so that the circulation passage 807*a* is opened, and fuel with which vapor is mixed is circulated back into the fuel tank 20. Then, when the plunger 804 moves further and thus enters the later stage of the pressure-feeding stroke, the spill valve 820 closes of the circulation passage 807*a,* and the pressure of the fuel is simultaneously increased even further.

Furthermore, the spill valve 820 moves as a unit with the plunger 804, and at the point in time where the pressure of the fuel rises to a specified pressure, this fuel pressure (pressure of the fuel) causes the outlet check valve 830 to open against the urging force of the coil spring 850. Consequently, the fuel whose pressure has been increased to a specified level passes through the fuel passages 813, 815, 833 and 840*a* from the operating chamber W, and flows into the injection nozzle 1000 via the inlet orifice nozzle 60.

Next, fuel with a specified flow rate of Qret (of the fuel Qin that has flowed into the injection nozzle 1000) passes through the outlet orifice nozzle 70, and is circulated back to the fuel tank 20 via the fuel return pipe 130, so that fuel Qout equal to the difference between the flow rates Qin and Qret is injected from the injection port 1013 as injected fuel.

Thus, since the vapor mixed with the fuel is expelled in the initial stage of the fuel pressure-feeding stroke, i.e., before the fuel is metered by the inlet orifice nozzle 60, fuel from which almost all vapor has been expelled flows into the injection nozzle 1000. As a result, especially at high temperatures, the amount of fuel that is injected is controlled with high precision, and stabilized control can be performed. Furthermore, in the pressure-feeding stroke performed by the plunger 804, an increase in the pressure of the fuel is performed in each cycle in the later region of the stroke, i.e., from a specified stroke position to the end of the stroke; accordingly, control error caused by vapor can be avoided.

Figure 17:
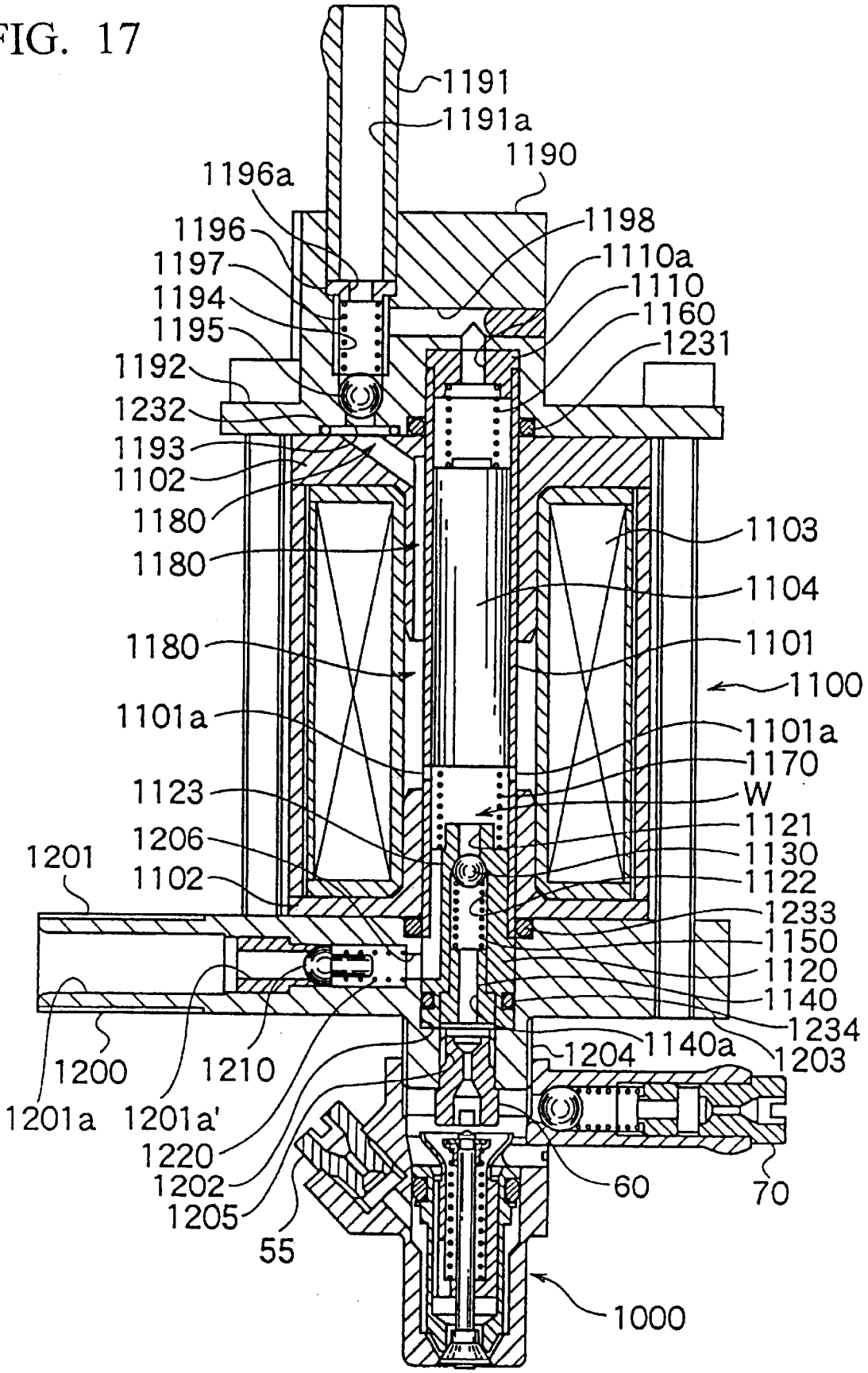
FIG. 17 is a sectional view showing another embodiment constituting a concrete realization of the system shown in FIG. 14.

FIG. 17 illustrates another embodiment of the second electronically controlled fuel injection device. In this embodiment, the path of the circulation passage, the valve body that opens and closes the circulation passage, the outlet check valve and the like are altered with respect to the above-mentioned embodiment shown in FIGS. 14 through 16. Accordingly, only the altered parts will be described here; constituent elements that are the same as in the above-mentioned embodiment are labeled with the same symbols, and a further description of these elements is omitted.

In the plunger pump 1100 of this embodiment, as is shown in FIG. 17, a core 1102 is joined to the outer circumference of a cylinder 1101 comprising a cylindrical body that has a cylindrical shape, and a solenoid coil 1103 is wound around the outer circumference of the core 1102. A cylindrical plunger 1104 formed as a solid member is inserted into the cylinder 1101 so that the plunger 1104 tightly contacts the cylinder 1101, and so that the plunger 1104 can undergo reciprocating motion by sliding in the axial direction through the cylinder 1101.

A stopper 1110 which has a fuel passage 1110*a* is mounted by engagement on one end of the cylinder 1101, and a tubular member 1120 is fastened by engagement to the other end. A fuel passage 1121 which has a reduced diameter and a fuel passage 1122 which has an expanded diameter are formed inside the tubular member 1120; furthermore, a fuel passage 1123 which extends in the axial direction is formed on the outer circumferential surface of the tubular member 1120.

Furthermore, an outlet check valve 1130 is disposed inside the fuel passage 1122 that has an expanded diameter so that the outlet check valve 1130 is free to undergo reciprocating motion, and the check valve 1130 is urged by a coil spring 1150 disposed between the check valve 1130 and a stopper 1140 that is fastened by engagement to the end portion of the tubular member 1120, so that the check valve 1130 blocks the reduced-diameter fuel passage 1121.

Furthermore, respective coil springs 1160 and 1170 are disposed between the plunger 1104 and the stopper 1110, and between the plunger 1104 and the tubular member 1120. These coil springs 1160 and 1170 form elastic bodies that drive the plunger 1104 in the direction of the reciprocating motion. Furthermore, the space in which the coil spring 1170 is disposed is the operating chamber W of the plunger 1104.

A spill port 1101*a* is formed in the cylinder 1101, so that the operating chamber W inside the cylinder 1101 can communicate with a circulation passage 1180 formed on the outside of the cylinder 1101.

Furthermore, a connector member 1190 and a spacer member 1200 are fastened by means of bolts to opposite ends of the cylinder 1101. The connector member 1190 is formed by a connector part 1191 which demarcates a circulation passage 1191*a,* a fastening flange part 1192, a reduced-diameter circulation passage 1193 that communicates with the circulation passage 1180, and an expanded diameter circulation passage 1194. Furthermore, a pressurizing valve 1195 is disposed inside the circulation passage 1194 so that the pressurizing valve 1195 is free to undergo reciprocating motion, and the pressurizing valve 1195 is urged by a coil spring 1197 disposed between the pressurizing valve 1195 and a stopper 1196 so that the pressurizing valve 1195 blocks the reduced diameter fuel passage 1193. Furthermore, a fuel passage 1198 communicates with the circulation passage 1194 and the fuel passage 1110*a.*

The spacer member 1200 is formed by a connector part 1201 which demarcates a fuel supply passage 1201*a,* an engagement hole 1202 which engages the tubular member 1120, a fastening flange part 1203, a male screw part 1204 which is used to connect the injection nozzle 1000, and an internal passage 1205 which communicates with the engagement hole 1202.

Furthermore, a check valve 1210 is disposed in the connector part 1201, and the check valve 1210 is urged toward the upstream side by a coil spring 1220 so that a fuel supply passage 1201*a* is blocked. Moreover, when the check valve 1210 opens, the fuel supply passage 1201*a* communicates with the operating chamber W via an opening part 1206 and the fuel passage 1123. Furthermore, an inlet orifice nozzle 60 is attached to the internal passage 1205. Moreover, the connector member 1190 and spacer member 1200 are connected to the pump main body via O-rings 1231, 1232, 1233 and 1234.

Here, to describe the operation of the plunger pump 1100 and injection nozzle 1000, when the plunger 1104 moves in one direction (upward in FIG. 17) in the fuel suction stroke, the pressure inside the operating chamber W drops so that the check valve 1210 opens. Furthermore, the fuel that is conducted from the fuel tank 20 via the low-pressure filter 120 is sucked into the operating chamber W via the fuel supply passage 1201*a,* opening part 1206 and fuel passage 1123.

Meanwhile, while the plunger 1104 moves in the opposite direction (downward in FIG. 17) in the fuel pressure-feeding stroke, the pressurizing valve 1195 opens when the fuel that is pressure-fed in the initial region of this movement reaches a specified pressure (pressurization) or greater, so that the circulation passage 1193 is opened, and fuel with which vapor is mixed is circulated back into the fuel tank 20 via the spill port 1101*a* and circulation passages 1180, 1193, 1194, 1196*a* and 1191*a*. Then, when the plunger 1104 moves even further so that the plunger 1104 enters the later region of the pressure-feeding stroke, the outer circumferential surface of the plunger 1104 blocks the spill port 1101*a,* and at the same time, the pressure of the fuel is increased even further.

Then, at the point in time where the pressure of the fuel is increased to a specified pressure, the outlet check valve 1130 opens so that the fuel passage 1121 is opened. At the same time, fuel whose pressure has been increased to a specified level passes through the fuel passages 1121, 1122 and 1140*a,* and flows into the injection nozzle 1000 via the inlet orifice nozzle 60.

Then, fuel at a specified flow rate of Qret (of the fuel Qin that has flowed into the injection nozzle 1000) passes through the outlet orifice nozzle 70, and is circulated back into the fuel tank 20 via the fuel return pipe 130, so that fuel Qout equal to the difference between the flow rates Qin and Qret is injected from the injection port 1013 as injected fuel.

Thus, since the vapor mixed with the fuel is expelled in the initial region of the fuel pressure-feeding stroke, i.e., before the fuel is metered by the inlet orifice nozzle 60, fuel from which almost all vapor has been expelled flows into the injection nozzle 1000. As a result, especially at high temperatures, the amount of fuel that is injected is controlled with high precision, and stabilized control can be performed. Furthermore, in the pressure-feeding stroke performed by the plunger 1104, an increase in the pressure of the fuel is performed in each cycle in the later region of the stroke, i.e., from a specified stroke position to the end of the stroke; accordingly, control error caused by vapor can be avoided.

Figure 18:
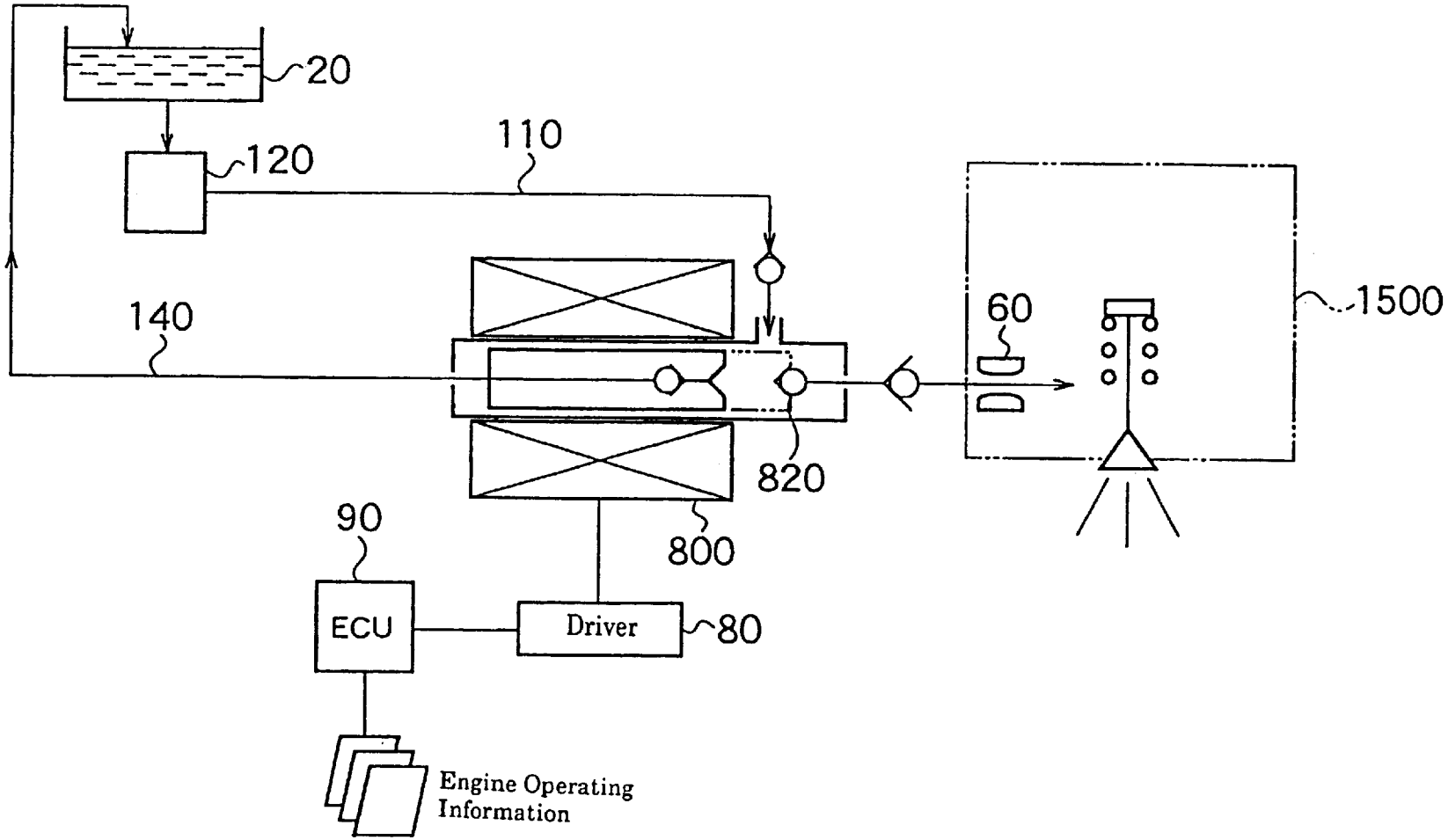
FIG. 18 is a schematic diagram showing one embodiment of a third electronically controlled fuel injection device of the present invention.
Figure 19:
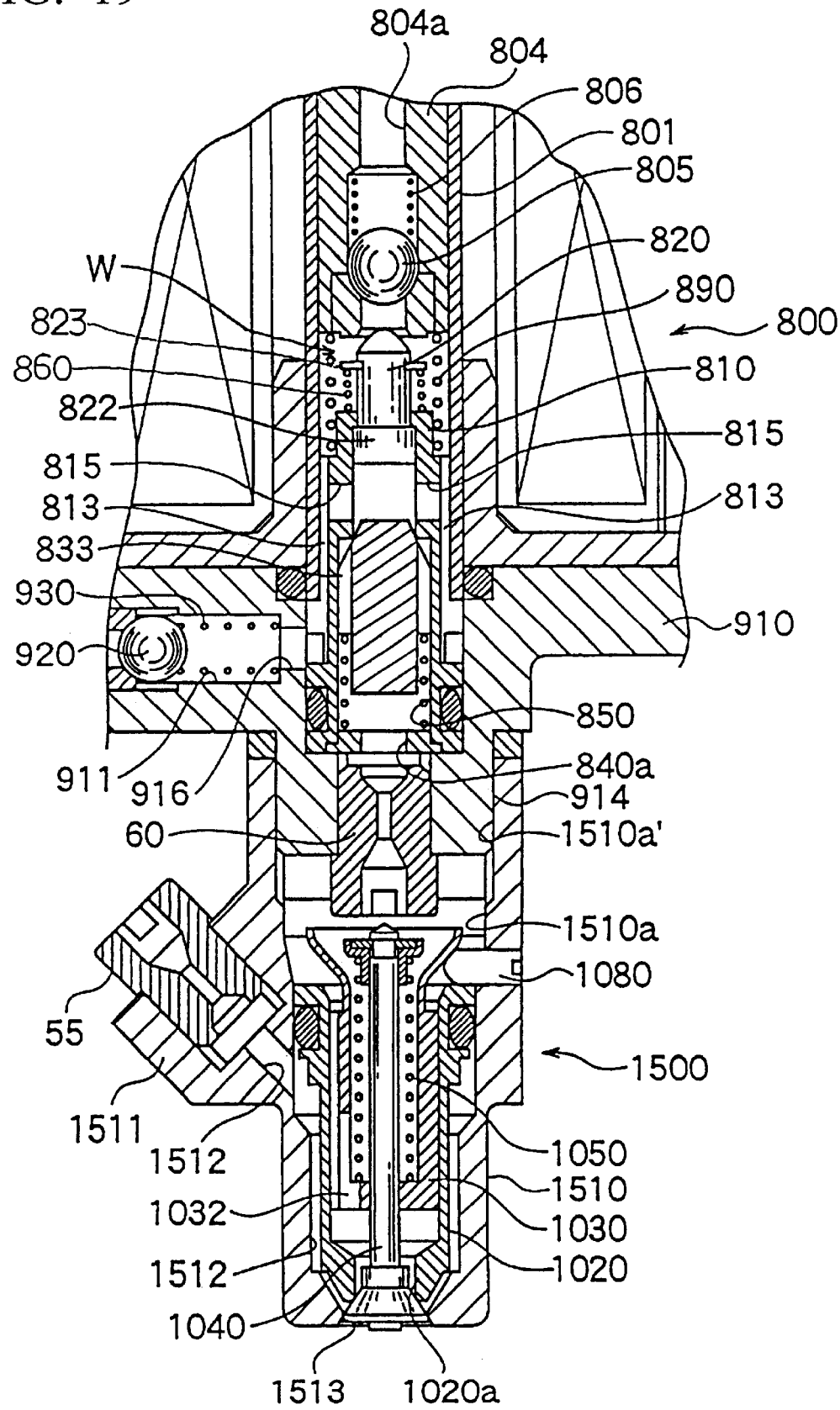
FIG. 19 is a partial enlarged sectional view showing the plunger pump and injection nozzle used in the concrete realization of the system shown in FIG. 18.

FIGS. 18 and 19 illustrate an embodiment of a third electronically controlled fuel injection device of the present invention. FIG. 18 is a schematic diagram of the system, and FIG. 19 is an enlarged sectional view of the main parts.

As is shown in FIG. 18, the electronically controlled fuel injection device of this embodiment comprises as basic constituent elements a plunger pump 800 used as an electromagnetically driven pump that pressure-feeds fuel from the fuel tank 20 of a two-wheeled vehicle, a circulation passage 140 which circulates fuel that has been pressurized to a specified pressure or greater in a specified initial region of the pressure-feeding stroke performed by the plunger pump 800 back into the fuel tank 20, a spill valve 820 comprising a valve body which blocks the fuel passage in the later stage of the pressure-feeding stroke but not the initial stage, an inlet orifice nozzle 60 which has an orifice part that allows the passage of fuel that has been pressurized to a specified pressure in the later stage of the pressure-feeding stroke, an injection nozzle 1500 which injects fuel that has passed through the inlet orifice nozzle 60 into the intake passage (of the engine) when this fuel exceeds a specified pressure, and a driver 80 and control unit (ECU) 90 used as control means that send control signals to the plunger pump 800 and the like on the basis of engine operating information. Specifically, this electronically controlled fuel injection device has a construction in which the outlet orifice nozzle 70 and fuel return pipe 130 of the electronically controlled fuel injection device shown in the above-mentioned FIGS. 14 through 16 are omitted. Accordingly, only the altered parts will be described here; constituent elements that are the same as in the above-mentioned device are labeled with the same symbols, and a further description of these elements is omitted.

As is shown in FIG. 19, the injection nozzle 1500 of this embodiment comprises a cylindrical body 1510 which demarcates a fuel passage 1510*a,* a tubular guide member 1020 which is disposed inside the cylindrical body 1510, a tubular retaining member 1030 which is inserted into the guide member 1020 so that the retaining member 1030 is free to undergo reciprocating motion, a poppet valve body 1040 which is disposed inside the retaining member 1030 so that the poppet valve body 1040 is free to undergo reciprocating motion, and which opens and closes a fuel injection passage 1020*a,* and an urging spring 1050 which is held in the retaining member 1030, and which urges the poppet valve body 1040 with a specified urging force so that the fuel injection passage 1020*a* is ordinarily blocked.

As is shown in FIG. 19, only a flange part 1511 is formed on the outer circumferential portion of the cylindrical body

1510, and an assist air orifice nozzle 55 is screw-engaged with this flange part 1511. Furthermore, the air that passes through this assist air orifice nozzle 55 passes through an assist air passage 1512 and jets from the injection port 1513, so that this air assists in the atomization of the injected fuel.

As is shown in FIG. 19, a female screw part 1510*a* is formed in the upper end region of the above-mentioned cylindrical body 1510, and a male screw part 914 on a spacer member 910 positioned at the lower end of the plunger pump 800 is screw-engaged with the female screw part 1510*a* so that the plunger pump 800 and injection nozzle 1500 are joined into an integral unit. As a result, both parts can be handled as a single module as described above, so that the amount of assembly work required can be reduced, the convenience of handling is improved, and the size of the apparatus can be reduced.

Here, to describe the operation of the plunger pump 800 and injection nozzle 1500, when the plunger 804 moves in one direction (upward in FIG. 19) in the fuel suction stroke, the pressure inside the operating chamber W drops so that the check valve 920 opens. Then, the fuel that is conducted via the low-pressure filter 120 from the fuel tank 20 passes through the fuel supply passage 911, opening part 916 and fuel passage 813, and is sucked into the operating chamber W.

Meanwhile, while the plunger 804 moves in the opposite direction (downward in FIG. 19) in the fuel pressure-feeding stroke, the pressurizing valve 805 opens when the fuel that is pressure-fed in the initial region of this movement reaches a specified pressure (pressurization) or greater, so that the circulation passage 807*a* is opened, and fuel with which vapor is mixed is circulated back into the fuel tank 20. Then, when the plunger 804 moves even further so that the plunger 804 enters the later region of the pressure-feeding stroke, the spill valve 820 blocks the circulation passage 807*a,* and at the same time, the pressure of the fuel is increased even further.

Then, at the point in time where the spill valve 820 has moved a specified distance as a unit with the plunger 804, the expanded-diameter part 822 of the spill valve 820 contacts the tip end portion 831 of the outlet check valve 830, and opens the outlet check valve 830 against the urging force of the coil spring 850. Accordingly, fuel whose pressure has been increased to a specified level passes through the fuel passages 813, 815, 833 and 840*a* from the operating chamber W, and flows into the injection nozzle 1500 via the inlet orifice nozzle 60.

Then, when the pressure of the fuel that has flowed into the injection nozzle 1500 is raised even further to a specified pressure, the poppet valve body 1040 is opened against the urging force of the coil spring 1050, so that the fuel is injected from the injection port 1513.

In this system, since the plunger pump 800 is driven using only time as a control parameter, the expulsion of vapor can be accomplished with good efficiency even if circulation using an outlet orifice nozzle 70 of the type described above is not performed (i.e. even when the outlet orifice nozzle 70 and fuel return pipe 130 are omitted); furthermore, a region of good linearity of the inlet orifice nozzle 60 can be used.

Specifically, since driving is accomplished by time control of the specified time for which the plunger pump 800 is powered by a specified level of current, vapor that is mixed with the fuel is positively expelled in the initial region of the fuel pressure-feeding stroke, i.e., before the fuel is metered by the inlet orifice nozzle 60; furthermore, high-precision metering can be performed by the inlet orifice nozzle 60.

As a result, the amount of injected fuel can be controlled with high precision, especially at high temperatures, and stabilized control can be performed. Furthermore, in the pressure-feeding stroke of the plunger 804, an increase in the pressure of the fuel is performed in each cycle in the later region of the stroke, i.e., from a specified stroke position to the end of the stroke; accordingly, control error caused by vapor can be avoided.

In the embodiments described above, the driver 80 and control unit 90 used as control means for controlling the driving of the plunger pumps 30, 300, 800 and 1100 consist of software and hardware used to calculate the injection timing, injection time, powering current value or voltage and the like in accordance with engine operating information obtained from sensors on the basis of a predetermined control map or the like, and to output control signals, in accordance with the operating conditions of the engine.

Next, the operation of the electronically controlled fuel injection device of the present invention will be described.

First, when engine operating information is detected by the rotational speed sensor, water temperature sensor, pressure sensor, throttle opening sensor and the like, various calculations are performed by the driver 80 and control unit 90, and specified control signals are sent to the plunger pump 30, 300, 800 or 1100.

Here, the control signals are pulse width modulated (PWM) control signals, and driving is performed so that the driving frequency of the plunger 34, 804 or 1104 of the plunger pump 30, 300, 800 or 1100 is synchronized with the cycle of the engine. Specifically, in a four-cycle engine, for example, driving is performed so that the frequency is 10 Hz in a case where the engine rpm is 1200 rpm, 50 Hz in a case where the rpm is 6000 rpm, and 83.3 Hz in a case where the rpm is 10,000 rpm. Furthermore, driving is performed in a specified region of the intake stroke of the engine.

Figure 20A:
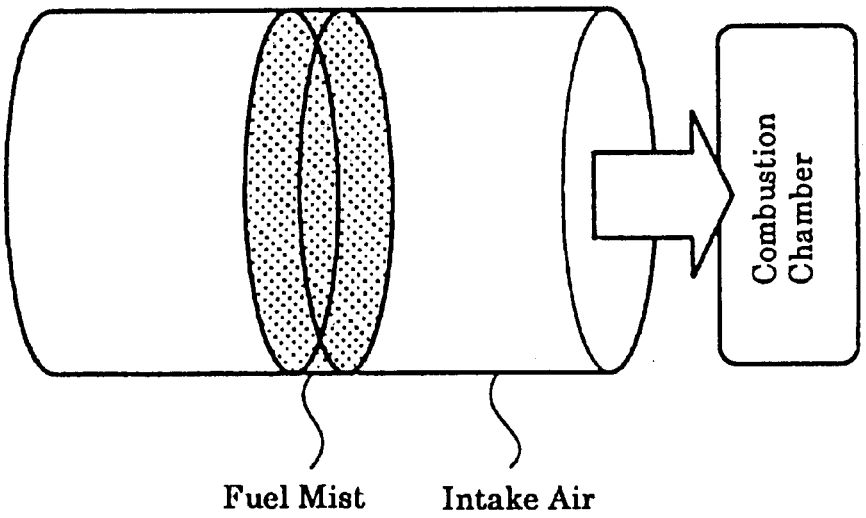
FIGS. 20(*a*) and 20(*b*) show the conditions of fuel supply in the electronically controlled fuel injection device in schematic terms, FIG. 20(*a*) being a schematic diagram showing non-uniform mixing conditions, and FIG. 20(*b*) being a schematic diagram showing uniform mixing conditions.
Figure 20B:
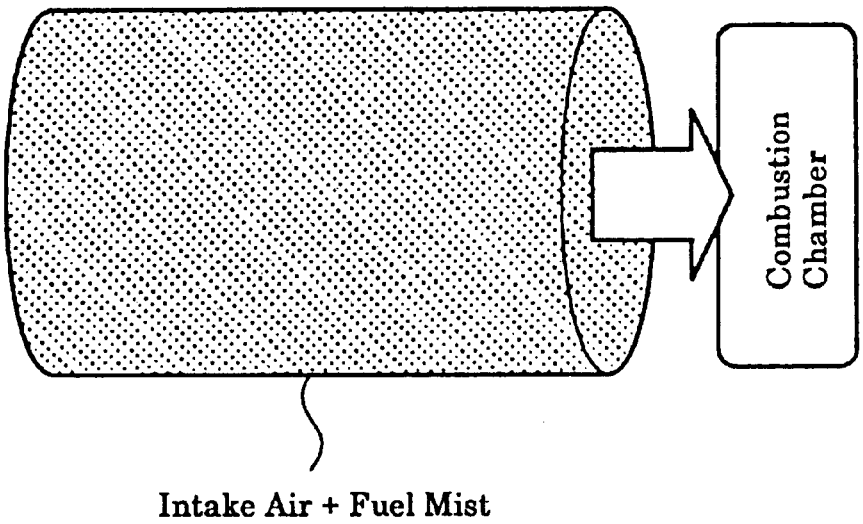

Furthermore, in cases where the load on the engine is a relatively low load, the powering current value, i.e., the discharge pressure, is set at a relatively large value, the powering time is set at a relatively short value, and driving is performed so that fuel is intermittently injected in a specified short period of the intake stroke. The conditions of the supply of fuel to the intake in this case are shown schematically in FIG. 20(*a*). Specifically, by performing such intermittent fuel injection, it is possible to cause rare-mixture combustion; as a result, the amounts of exhaust gases such as carbon dioxide, hydrocarbons and the like can be efficiently reduced.

On the other hand, in cases where the load on the engine is a relatively high load, the powering current value, i.e., the discharge pressure, is set at a relatively small value, the powering time is set at a relatively long value, and driving is performed so that fuel is continuously injected for a period that extends over a specified length of the intake stroke. The conditions of the supply of fuel to the intake in this case are shown schematically in FIG. 20(*b*). Specifically, by performing such continuous fuel injection, it is possible to cause uniform-mixture combustion; as a result, the required driving characteristics and power (driveability and performance) can be ensured.

Figure 21:
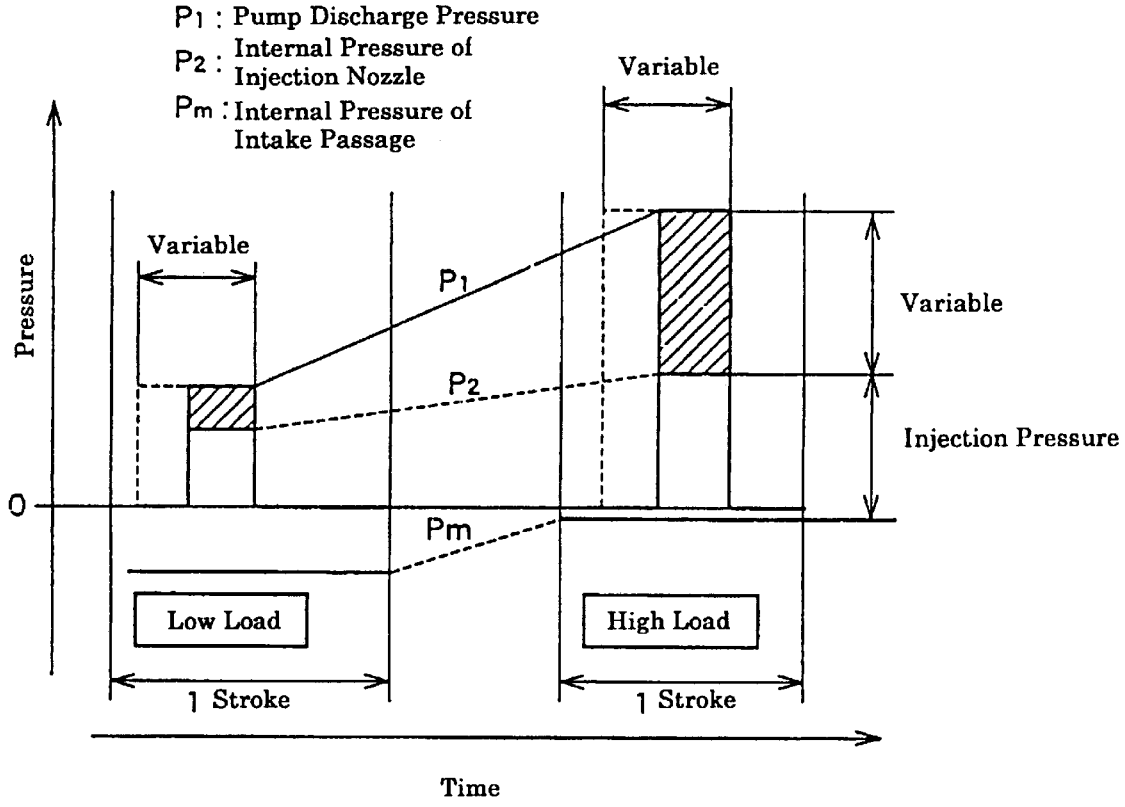
FIG. 21 is a schematic diagram which illustrates two-element control used in the control of a conventional electromagnetically driven pump.

As was described above, the plunger pumps 30, 300, 800 and 1100 use two elements, i.e., the current used to power the solenoid coil 33, 803 or 1103 (that is, the pressure of the fuel obtained by conversion from the current via electromagnetic force), and the powering time, as control parameters; accordingly, as is shown in FIG. 21, control can be accomplished by appropriately selecting these two control parameters in accordance with the operating conditions (low load or high load) of the engine and the like. As a result, an arbitrary mixed state suited to the operating conditions of the engine, i.e., a uniform mixed state in cases where power performance is considered to be important, or a non-uniform mixed state or intermediate mixed state in cases where rare combustion for the purpose of reducing the amounts of exhaust gases is considered to be important, can easily be obtained. Furthermore, the degree of freedom of control, i.e., the control width, can be increased, and the transient response characteristics are also advantageous. Moreover, since the amount of fuel injected varies with the current value and the pulse width, an interrupt increase or the like can easily be accomplished.

The fuel Qin that is pressure-fed from the plunger pump 30, 300, 800 or 1000 controlled as described above is introduced into the injection nozzle 50, 500 (500, 600, 700 or 1000, and some of this fuel is circulated back to the fuel tank 20 as return fuel (bias flow rate) Qret, so that fuel Qout equal to the difference between the flow rates Qin and Qret is injected from the injection nozzle 50, 500 (500, 600, 700 or 1000 as injected fuel. Furthermore, the injected fuel is supplied to the intake passage 21*a* of the engine while being agitated by assist air so that atomization of the fuel is promoted.

Especially in the case of the plunger pumps 800 and 1100, vapor is expelled in the initial region of the pressure-feeding stroke prior to the metering of the fuel by the inlet orifice nozzle 60; accordingly, control of the amount of injection at high temperatures is especially stable.

Meanwhile, in the system shown in FIG. 18, since only time is used as a control parameter in the driving of the plunger pump 800, vapor can be expelled with good efficiency without using a bias flow rate, and a region of good linearity of the inlet orifice nozzle 60 can be used, so that the amount of injection can be controlled with high precision.

Furthermore, superimposed driving in which an auxiliary pulse consisting of a smaller current is superimposed on a fundamental pulse consisting of a current at a specified level may also be used as the method that controls the plunger pump 30, 300, 800 or 1100.

Figure 22:
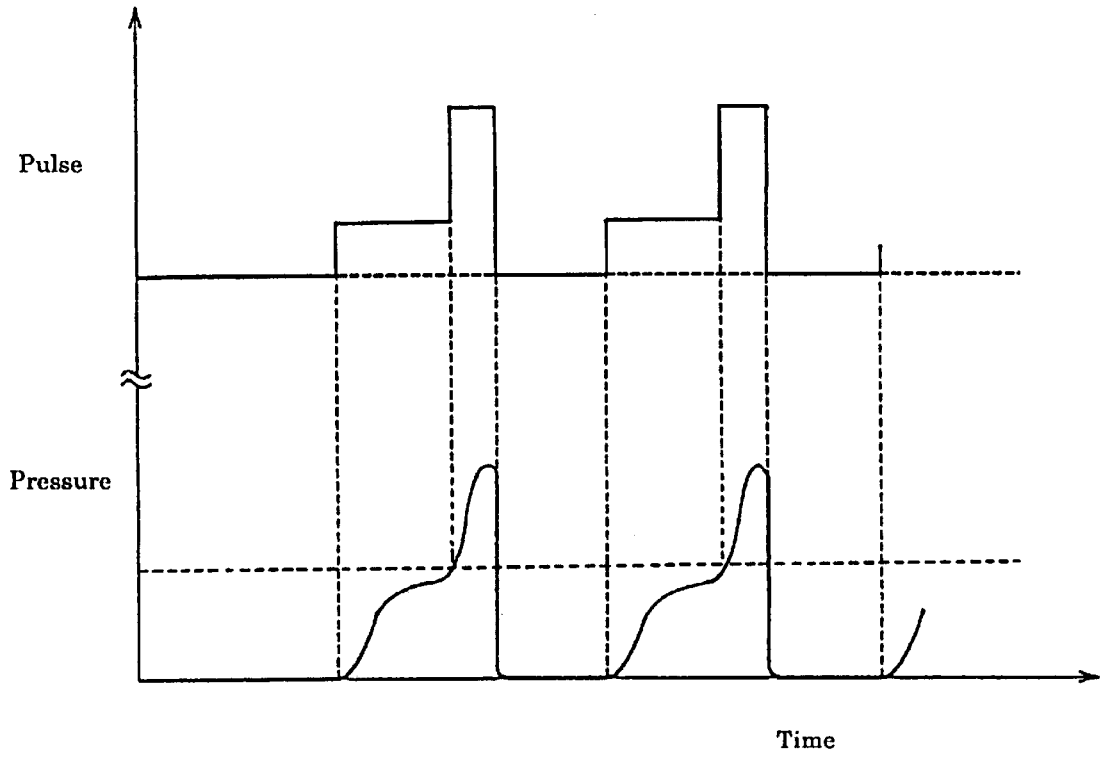
FIG. 22 shows a continuous pulse control pattern obtained by superimposed driving in the control of the electromagnetically driven pump.
Figure 23:
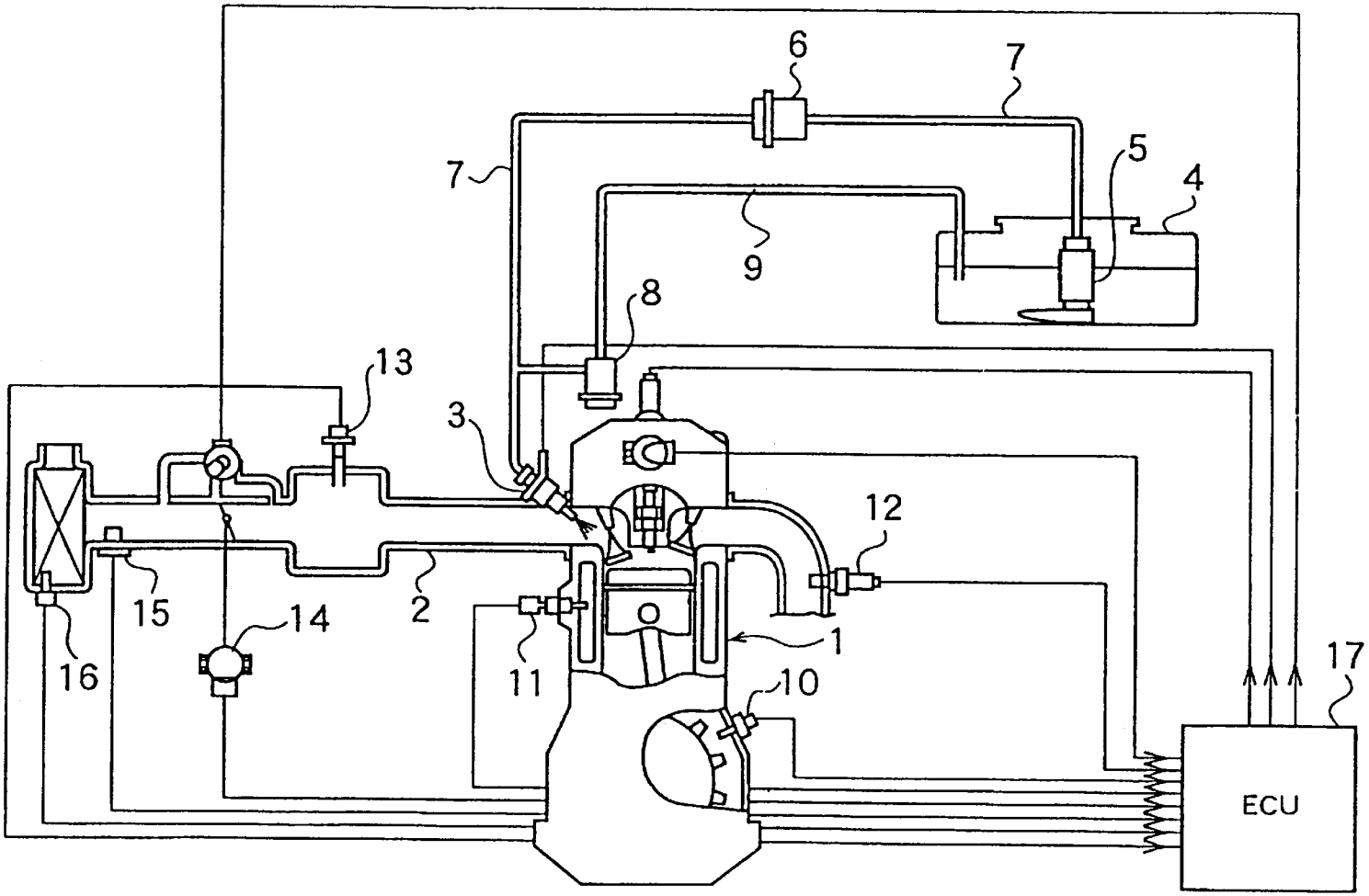
FIG. 23 is a schematic structural diagram which shows the overall construction of a conventional electronically controlled fuel injection device.

In this superimposed driving, the driving current (pressure) and pulse width (powering time) are made variable, and two different pulses are superimposed. For example, as is shown in FIG. 22, a continuous pulse control pattern in which an auxiliary pulse is added in front of a fundamental pulse the like may be used.

In this superimposed driving, the bias current is increased, so that the expulsion of vapor can be promoted even further, thus improving the idling stability at high temperatures. Furthermore, even if air is introduced into the fuel lines due to fuel deficiency (e.g. an empty fuel tank) or during assembly, recovery to the original function is greatly improved.

In the above-mentioned constructions, the discharge pressure of the plunger pump 30, 300, 800 or 1100 is set so that the fuel injection pressure is in the desired range; this pressure is set at an appropriate desired value with the vapor generation limit at which fuel vapor tends to be generated being taken into account.

In the embodiments described above, a two-wheeled vehicle was described as an example of the vehicle in which the engine was mounted. However, the present invention is not limited to such vehicles; the invention can also be appropriately applied in other cases where an engine with a relatively small displacement is mounted, such as three-wheeled or four-wheeled carts, and boats such as leisure boats and the like.

Industrial Applicability

In the electronically controlled fuel injection device of the present invention, as was described above, a simple combination of an electromagnetically driven pump which allows control over a broad range in accordance with the operating conditions of the engine, and an injection nozzle that is equipped with an inlet orifice nozzle and an outlet orifice nozzle, is used. Accordingly, the amount of exhaust gases and the like can be efficiently reduced while placing an emphasis on operating characteristics and power performance. In particular, since two-element control in which control is accomplished by means of the electromagnetically driven pump is accomplished by means of the two elements of powering current (i.e., discharge pressure of the fuel) and powering time can be employed, arbitrary fuel mixture conditions suited to the operating conditions of the engine can easily be established. Furthermore, a large control width can be obtained, and the system is also superior in terms of transient response characteristics, so that an optimal combustion state based on precise control can be obtained overall.

Furthermore, as a result of the use of a plunger pump (which is especially superior in terms of auto-suction performance) as the electromagnetically driven pump, in-line installation is possible, so that the degree of freedom in layout and design is increased, thus making it possible to achieve a compact installed structure while using a conventional fuel tank, especially in the case of mounting in a two-wheeled vehicle or the like.

Furthermore, there is no need for a conventional high-pressure filter; a low-pressure filter employed in systems using carburetors may be used. Furthermore, since there is no need for a pressure-resistant structure, the piping can be simplified and thin piping materials can be used, so that a reduction in the weight, size and cost of the overall supply system can be achieved.

Furthermore, in the electronically controlled fuel injection device of the present invention, fuel with which vapor is mixed is pressure-fed by the electromagnetically driven pulp and circulated back into the fuel tank in the initial region of the pressure-feeding stroke prior to the metering of the fuel by the inlet orifice nozzle; accordingly, the amount of fuel injected can be controlled with high precision, especially at high temperatures.

What is claimed is:

1. An electronically controlled fuel injection device comprising:

a positive displacement, electromagnetically driven pump for use in pumping fuel under pressure from a fuel tank;

an inlet orifice nozzle operably coupled to said electromagnetically driven pump and having an inlet nozzle orifice part arranged to allow passage therethrough of the fuel pumped by said electromagnetically driven pump;

an outlet orifice nozzle having an intake side operably coupled to said inlet orifice nozzle and an output side to be coupled to a return line for return of fuel to the fuel tank, said outlet orifice nozzle comprising an outlet nozzle orifice part arranged to allow a specified amount of the fuel that has passed through said inlet nozzle orifice part to pass from said intake side out through said output side to be returned to the fuel tank;

an injection nozzle, operably coupled to said inlet orifice nozzle and arranged to be coupled to an intake passage of an engine, so as to inject an amount of fuel into the intake passage of the engine equal to a difference between an amount of the fuel that has passed through said inlet nozzle orifice part and the specified amount of the fuel that has passed out through said output side to be returned to the fuel tank; and a control arrangement operably coupled to said electromagnetically driven pump to control said electromagnetically driven pump in response to a cycle of the engine.

2. An electronically controlled fuel injection device according to claim 1, wherein said electromagnetically driven pump comprises:

a plunger-receiving body having a passage extending therethrough;

a plunger reciprocally disposed in said passage of said plunger-receiving body for reciprocating motion in first and second opposing directions, said plunger being tightly contacted with an interior of said passage of said plunger-receiving body, and said plunger having a fuel passage therethrough extending in said first and second opposing directions for flow of fuel therethrough in a downstream direction;

a first check valve arranged to normally block said fuel passage of said plunger and to open said fuel passage of said plunger upon movement of said plunger in said first direction;

an elastic body supported on said plunger-receiving body and operably engaged with said plunger to urge said plunger in a direction of said reciprocating motion;

a second check valve arranged, on a downstream side of said plunger with respect to the flow of fuel, to normally block said passage of said plunger-receiving body and to open said passage of said plunger-receiving body upon movement of said plunger in said second direction; and a solenoid coil arranged to apply an electromagnetic force to said plunger to cause movement of said plunger in one of said first and second directions.

3. An electronically controlled fuel injection device according to claim 1, wherein said injection nozzle comprises:

a valve-receiving body having an injection nozzle fuel passage communicating with said inlet orifice nozzle and said outlet orifice nozzle and leading to an injection port;

an injection nozzle valve body arranged for reciprocating motion in said valve-receiving body to open and close said injection nozzle fuel passage; and an urging spring operably engaged with said injection nozzle valve body to urge said injection nozzle valve body toward a position to close said injection nozzle fuel passage.

4. An electronically controlled fuel injection device according to claim 3, wherein said injection nozzle further includes an assist air passage arranged to allow the passage therethrough of assist air for assisting in atomization of the fuel injected from said injection nozzle.

5. An electronically controlled fuel injection device according to claim 3, wherein said injection nozzle further includes an adjustment mechanism for adjusting an urging force of said urging spring.

6. An electronically controlled fuel injection device according to claim 1, wherein said injection nozzle further includes a back-flow preventing valve arranged to prevent back-flow of fuel from said outlet orifice nozzle.

7. An electronically controlled fuel injection device according to claim 6, wherein said back-flow preventing valve is arranged to allow fuel flow out through said outlet orifice nozzle when the fuel reaches at least an opening pressure;

said injection nozzle further includes an adjuster for adjusting said opening pressure at which said back-flow preventing valve allows the fuel flow through said outlet orifice nozzle.

8. An electronically controlled fuel injection device according to claim 1, wherein said electromagnetically driven pump and said injection nozzle are formed as an integral unit.

9. An electronically controlled fuel injection device according to claim 1, wherein said control arrangement is operable to control said electromagnetically driven pump by using, as control parameters, at least an amount of current that flows through said electromagnetically driven pump and an amount of time for which the current flows through said electromagnetically driven pump.

10. An electronically controlled fuel injection device according to claim 1, wherein said control arrangement is operable to control said electromagnetically driven pump by superimposed driving in which an auxiliary pulse that is smaller than a specified level is superimposed on a fundamental pulse consisting of a current of said specified level.

11. An electronically controlled fuel injection device according to claim 1, wherein said electromagnetically driven pump comprises a plunger-receiving body having a passage extending therethrough, and a plunger reciprocally disposed in said passage of said plunger-receiving body, an operating chamber being defined at least partially in said plunger-receiving body at one end of said plunger, said electromagnetically driven pump being arranged to perform a fuel-suction stroke to reduce pressure in said operating chamber to draw fuel thereinto from a fuel tank, and a pressure-feeding stroke, having an initial stage and a later stage, for use in pumping fuel under pressure from said operating chamber.

12. An electronically controlled fuel injection device comprising:

a positive displacement, electromagnetically driven pump arranged to perform a pressure-feeding stroke, having an initial stage and a later stage, for use in pumping fuel under pressure from a fuel tank;

an inlet orifice nozzle operably coupled to said electromagnetically driven pump and having an inlet nozzle orifice part arranged to allow passage therethrough of the fuel pumped by said electromagnetically driven pump;

an outlet orifice nozzle having an intake side operably coupled to said inlet orifice nozzle and an output side to be coupled to a return line for return of fuel to the fuel tank, said outlet orifice nozzle comprising an outlet nozzle orifice part arranged to allow a specified amount of the fuel that has passed through said inlet nozzle orifice part to pass from said intake side out through said output side to be returned to the fuel tank;

an injection nozzle, operably coupled to said inlet orifice nozzle and arranged to be coupled to an intake passage of an engine, so as to inject an amount of fuel into the intake passage of the engine equal to a difference between an amount of the fuel that has passed through said inlet nozzle orifice part and the specified amount of the fuel that has passed out through said output side to be returned to the fuel tank;

a circulation passage arranged to be operably coupled to the fuel tank to circulate fuel pressurized to a first specified pressure by said electromagnetically driven pump back to the fuel tank;

a valve body arranged to allow fuel flow through said circulation passage back to the fuel tank during said initial stage of said pressure-feeding stroke of said electromagnetically driven pump and to block fuel flow through said circulation passage back to the fuel tank during said later stage of said pressure-feeding stroke of said electromagnetically driven pump; and a control arrangement operably coupled to said electromagnetically driven pump to control said electromagnetically driven pump in response to a cycle of the engine.

13. An electronically controlled fuel injection device according to claim 12, wherein said electromagnetically driven pump, said circulation passage and said valve body are arranged such that said electromagnetically driven pump, during said initial stage of said pressure-feeding stroke, generates fuel pressure to cause said fuel flow through said circulation passage to allow the fuel to return to the fuel tank.

14. An electronically controlled fuel injection device according to claim 12, wherein said electromagnetically driven pump comprises a plunger-receiving body having a passage extending therethrough, and a plunger reciprocally disposed in said passage of said plunger-receiving body, an operating chamber being defined at least partially in said plunger-receiving body at one end of said plunger, said electromagnetically driven pump being arranged to perform a fuel-suction stroke to reduce pressure in said operating chamber to draw fuel thereinto from a fuel tank, and a pressure-feeding stroke, having an initial stage and a later stage, for use in pumping fuel under pressure from said operating chamber.

15. An electronically controlled fuel injection device according to claim 12, wherein said electromagnetically driven pump comprises a plunger-receiving body having a passage extending therethrough, and a plunger reciprocally disposed in said passage of said plunger-receiving body;

a spill port is formed in said pressure-receiving body and communicates with said circulation passage; and said valve body is constituted by said plunger and is arranged to open said spill port in said initial stage of said pressure-feeding stroke to allow the fuel flow through said circulation passage and to close said spill port in said later stage of said pressure-feeding stroke to block the fuel flow through said circulation passage.

16. An electronically controlled fuel injection device according to claim 12, wherein said electromagnetically driven pump comprises:

a plunger-receiving body having a passage extending therethrough;

a plunger reciprocally disposed in said passage of said plunger-receiving body for reciprocating motion in first and second opposing directions, said plunger being tightly contacted with an interior of said passage of said plunger-receiving body and being arranged to perform an intake stroke to suck in fuel by moving in said first direction and to perform said pressure feeding stroke to pressure feed the sucked-in fuel by moving in said second direction;

an elastic body operably engaged with said plunger to urge said plunger in a direction of said reciprocating motion;

a fuel passage arranged to communicate with said inlet orifice nozzle;

an outlet check valve arranged in said fuel passage to normally close said fuel passage of said electromagnetically driven pump and to open said fuel passage of said electromagnetically driven pump when the fuel pressure-fed by said plunger reaches at least a second specified pressure; and a solenoid coil arranged to apply an electromagnetic force to said plunger to cause movement of said plunger in one of said first and second directions.

17. An electronically controlled fuel injection device according to claim 16, wherein said circulation passage passes through said plunger in said first and second opposing directions;

a pressurizing valve is arranged to normally block said circulation passage, and to open said circulation passage when the fuel pressure-fed by said plunger reaches at least said first specified pressure.

18. An electronically controlled fuel injection device according to claim 17, wherein said valve body comprises a spill valve arranged to undergo reciprocating motion in said first and second opposing directions; and said outlet check valve and said valve body are arranged so that said outlet check valve opens said fuel passage of said electromagnetically driven pump at an intermediate part of said later stage of said pressure-feeding stroke of said electromagnetically driven pump.

19. An electronically controlled fuel injection device according to claim 16, wherein said circulation passage is formed on an outside of said plunger-receiving body of said electromagnetically driven pump; and a pressurizing valve is arranged to normally block said circulation passage, and to open said circulation passage when the fuel pressure-fed by said plunger reaches at least said first specified pressure.

20. An electronically controlled fuel injection device according to claim 19, wherein a spill port is formed in said plunger-receiving body and communicates with said circulation passage; and said valve body is constituted by said plunger, and is arranged to open said spill port in said initial stage of said pressure-feeding stroke and to close said spill port in said later stage of said pressure-feeding stroke.

21. An electronically controlled fuel injection device according to claim 12, wherein said circulation passage and said injection nozzle are arranged so that fuel being returned to the fuel tank by said circulation passage is circulated in a direction opposite to a direction in Which fuel is injected by said injection nozzle.

22. An electronically controlled fuel injection device according to claim 12, wherein said injection nozzle comprises:

a valve-receiving body having an injection nozzle fuel passage communicating with said inlet orifice nozzle and said outlet orifice nozzle and leading to an injection port;

an injection nozzle valve body arranged for reciprocating motion in said valve-receiving body to open and close said injection nozzle fuel passage; and an urging spring operably engaged with said injection nozzle valve body to urge said injection nozzle valve body toward a position to close said injection nozzle fuel passage.

23. An electronically controlled fuel injection device according to claim 22, wherein said injection nozzle further includes an assist air passage arranged to allow the passage therethrough of assist air for assisting in atomization of the fuel injected from said injection nozzle.

24. An electronically controlled fuel injection device according to claim 12, wherein said injection nozzle further includes a back-flow preventing valve arranged to prevent back-flow of fuel from said outlet orifice nozzle.

25. An electronically controlled fuel injection device according to claim 24, wherein said back-flow preventing valve is arranged to allow fuel flow out through said outlet orifice nozzle when the fuel reaches at least an opening pressure;

said injection nozzle further includes an adjuster for adjusting said opening pressure at which said back-flow preventing valve allows the fuel flow through said outlet orifice nozzle.

26. An electronically controlled fuel injection device according to claim 12, wherein said electromagnetically driven pump and said injection nozzle are formed as an integral unit.

27. An electronically controlled fuel injection device according to claim 12, wherein said control arrangement is operable to control said electromagnetically driven pump by using, as control parameters, at least an amount of current that flows through said electromagnetically driven pump and an amount of time for which the current flows through said electromagnetically driven pump.

28. An electronically controlled fuel injection device according to claim 12, wherein said control arrangement is operable to control said electromagnetically driven pump by superimposed driving in which an auxiliary pulse that is smaller than a specified level is superimposed on a fundamental pulse consisting of a current of said specified level.

29. An electronically controlled fuel injection device according to claim 12, wherein said control arrangement is operable to supply power to said electromagnetically driven pump at least during said pressure-feeding stroke thereof.

30. An electronically controlled fuel injection device comprising:

a positive displacement, electromagnetically driven pump arranged to perform a pressure-feeding stroke, having an initial stage and a later stage, for use in pumping fuel under pressure from a fuel tank;

an inlet orifice nozzle operably coupled to said electromagnetically driven pump and having an inlet nozzle orifice part arranged to allow passage therethrough of the fuel pumped by said electromagnetically driven pump;

an injection nozzle, operably coupled to said inlet orifice nozzle and arranged to be coupled to an intake passage of an engine, so as to inject the fuel that has passed through said inlet orifice nozzle into the intake passage of the engine when the pressure of the fuel reaches at least a first specified pressure;

a circulation passage arranged to be operably coupled to the fuel tank to circulate fuel pressurized to a second specified pressure by said electromagnetically driven pump back to the fuel tank;

a valve body arranged to allow fuel flow through said circulation passage back to the fuel tank during said initial stage of said pressure-feeding stroke of said electromagnetically driven pump and to block fuel flow through said circulation passage back to the fuel tank during said later stage of said pressure-feeding stroke of said electromagnetically driven pump; and a control arrangement operably coupled to said electromagnetically driven pump to control said electromagnetically driven pump in response to a cycle of the engine;

wherein said electromagnetically driven pump, said circulation passage and said valve body are arranged such that said electromagnetically driven pump, during said initial stage of said pressure-feeding stroke, generates fuel pressure to cause said fuel flow through said circulation passage to allow the fuel to return to the fuel tank.

31. An electronically controlled fuel injection device according to claim 30, wherein said electromagnetically driven pump comprises:

a plunger-receiving body leaving a passage extending therethrough;

a plunger reciprocally disposed in said passage of said plunger-receiving body for reciprocating motion in first and second opposing directions, said plunger being tightly contacted with an interior of said passage of said plunger-receiving body and being arranged to perform an intake stroke to suck in fuel by moving in said first direction and to perform said pressure-feeding stroke to pressure feed the sucked-in fuel by moving in said second direction;

an elastic body operably engaged with said plunger to urge said plunger in a direction of said reciprocating motion;

a fuel passage arranged to communicate with said inlet orifice nozzle;

an outlet check valve arranged in said fuel passage to normally close said fuel passage of said electromagnetically driven pump and to open said fuel passage of said electromagnetically driven pump when the fuel pressure-fed by said plunger reaches at least a second specified pressure; and a solenoid coil arranged to apply an electromagnetic force to said plunger to cause movement of said plunger in one of said first and second directions.

32. An electronically controlled fuel injection device according to claim 31, wherein said circulation passage passes through said plunger in said first and second opposing directions;

a pressurizing valve is arranged to normally block said circulation passage, and to open said circulation passage when the fuel pressure-fed by said plunger reaches at least said first specified pressure.

33. An electronically controlled fuel injection device according to claim 32, wherein said valve body comprises a spill valve arranged to undergo reciprocating motion in said first and second opposing directions; and said outlet check valve and said valve body are arranged so that said outlet check valve opens said fuel passage of said electromagnetically driven pump at an intermediate part of said later stage of said pressure-feeding stroke of said electromagnetically driven pump.

34. An electronically controlled fuel injection device according to claim 33, wherein said circulation passage and said injection nozzle are arranged so that fuel being returned to the fuel tank by said circulation passage is circulated in a direction opposite to a direction in which fuel is injected by said injection nozzle.

35. An electronically controlled fuel injection device according to claim 31, wherein said control arrangement is operable to supply power to said solenoid coil of said electromagnetically driven pump at least during said pressure-feeding stroke thereof.

36. An electronically controlled fuel injection device according to claim 31, wherein said circulation passage is formed on an outside of said plunger-receiving body of said electromagnetically driven pump; and a pressurizing valve is arranged to normally block said circulation passage, and to open said circulation passage when the fuel pressure-fed by said plunger reaches at least said first specified pressure.

37. An electronically controlled fuel injection device according to claim 36, wherein a spill port is formed in said plunger-receiving body and communicates with said circulation passage; and said valve body is constituted by said plunger, and is arranged to open said spill port in said initial stage of said pressure-feeding stroke and to close said spill port in said later stage of said pressure-feeding stroke.

38. An electronically controlled fuel injection device according to claim 37, wherein said circulation passage and said injection nozzle are arranged so that fuel being returned to the fuel tank by said circulation passage is circulated in a direction opposite to a direction in which fuel is injected by said injection nozzle.

39. An electronically controlled fuel injection device according to claim 37, wherein said plunger has a solid end part to block fuel flow through said passage of said plunger-receiving body.

40. An electronically controlled fuel injection device according to claim 30, wherein said circulation passage and said injection nozzle are arranged so that fuel being returned to the fuel tank by said circulation passage is circulated in a direction opposite to a direction in which fuel is injected by said injection nozzle.

41. An electronically controlled fuel injection device according to claim 30, wherein said injection nozzle comprises:

a valve-receiving body having an injection nozzle fuel passage communicating with said inlet orifice nozzle to conduct fuel from said inlet orifice nozzle;

an injection nozzle valve body arranged for reciprocating motion in said valve-receiving body to open and close said injection nozzle fuel passage; and an urging spring operably engaged with said injection nozzle valve body to urge said injection nozzle valve body toward a position to close said injection nozzle fuel passage.

42. An electronically controlled fuel injection device according to claim 41, wherein said injection nozzle further includes an assist air passage arranged to allow the passage therethrough of assist air for assisting in atomization of the fuel injected from said injection nozzle.

43. An electronically controlled fuel injection device according to claim 41, wherein said injection nozzle further includes an adjustment mechanism for adjusting an urging force of said urging spring.

44. An electronically controlled fuel injection device according to claim 30, wherein said electromagnetically driven pump and said injection nozzle are formed as an integral unit.

45. An electronically controlled fuel injection device according to claim 30, wherein said control arrangement is operable to control said electromagnetically driven pump by using, as a control parameter, only an amount of time for which current flows through said electromagnetically driven pump.

46. An electronically controlled fuel injection device according to claim 30, wherein said injection nozzle has an injection port at one end thereof, and a poppet valve arranged at said injection port.

47. An electronically controlled fuel injection device according to claim 30, wherein an outlet check valve is arranged upstream of said inlet orifice nozzle to allow flow toward said inlet orifice nozzle only after the fuel pressure has reached a predetermined pressure.

48. An electronically controlled fuel injection device comprising:

a positive displacement, electromagnetically driven pump arranged to perform a pressure-feeding stroke, having an initial stage and a later stage, for use in pumping fuel under pressure from a fuel tank;

an inlet orifice nozzle operable coupled to said electromagnetically driven pump and having an inlet nozzle orifice part arranged to allow passage therethrough of the fuel pumped by said electromagnetically driven pump;

an injection nozzle, operably coupled to said inlet orifice nozzle and arranged to be coupled to an intake passage of an engine, so as to inject the fuel that has passed through said inlet orifice nozzle into the intake passage of the engine when the pressure of the fuel reaches at least a first specified pressure;

a circulation passage arranged to be operably coupled to the fuel tank to circulate fuel pressurized to a second specified pressure by said electromagnetically driven pump back to the fuel tank;

a valve body arranged to allow fuel flow through said circulation passage back to the fuel tank during said initial stage of said pressure-feeding stroke of said electromagnetically driven pump and to block fuel flow through said circulation passage back to the fuel tank during said later stage of said pressure-feeding stroke of said electromagnetically driven pump; and a control arrangement operably coupled to said electromagnetically driven pump to control said electromagnetically driven pump in response to a cycle of the engine;

wherein said electromagnetically driven pump comprises a plunger-receiving body having a passage extending therethrough, and a plunger reciprocally disposed in said passage of said plunger-receiving body;

wherein a spill port is formed in said pressure-receiving body and communicates with said circulation passage; and wherein said valve body is constituted by said plunger and is arranged to open said spill port in said initial stage of said pressure-feeding stroke to allow the fuel flow through said circulation passage and to close said spill port in said later stage of said pressure-feeding stroke to block the fuel flow through said circulation passage.

49. An electronically controlled fuel injection device according to claim 48, wherein said electromagnetically driven pump comprises:

a plunger-receiving body having a passage extending therethrough;

a plunger reciprocally disposed in said passage of said plunger-receiving body for reciprocating motion in first and second opposing directions, said plunger being tightly contacted with an interior of said passage of said plunger-receiving body and being arranged to perform an intake stroke to stick in fuel by moving in said first direction and to perform said pressure-feeding stroke to pressure feed the sucked-in fuel by moving in said second direction;

an elastic body operably engaged with said plunger to urge said plunger in a direction of said reciprocating motion;

a fuel passage arranged to communicate with said inlet orifice nozzle;

an outlet check valve arranged in said fuel passage to normally close said fuel passage of said electromagnetically driven pump and to open said fuel passage of said electromagnetically driven pump when the fuel pressure-fed by said plunger reaches at least a second specified pressure; and a solenoid coil arranged to apply an electromagnetic force to said plunger to cause movement of said plunger in one of said first and second directions.

50. An electronically controlled fuel injection device according to claim 48, wherein said control arrangement is operable to supply power to said solenoid coil of said electromagnetically driven pump at least during said pressure-feeding stroke thereof.

51. An electronically controlled fuel injection device according to claim 48, wherein said circulation passage and said injection nozzle are arranged so that fuel being returned to the fuel tank by said circulation passage is circulated in a direction opposite to a direction in which fuel is injected by said injection nozzle.

52. An electronically controlled fuel injection device according to claim 48, wherein said plunger has a solid end part to block fuel flow through said passage of said plunger-receiving body.

53. An electronically controlled fuel injection device according to claim 52, wherein said circulation passage and said injection nozzle are arranged so that fuel being returned to the fuel tank by said circulation passage is circulated in a direction opposite to a direction in which fuel is injected by said injection nozzle.

54. An electronically controlled fuel injection device according to claim 52, wherein said injection nozzle comprises:

a valve-receiving body having an injection nozzle fuel passage communicating with said inlet orifice nozzle to conduct fuel from said inlet orifice nozzle;

an injection nozzle valve body arranged for reciprocating motion in said valve-receiving body to open and close said injection nozzle fuel passage; and an urging spring operably engaged with said injection nozzle valve body to urge said injection nozzle valve body toward a position to close said injection nozzle fuel passage.

55. An electronically controlled fuel injection device according to claim 48, wherein said injection nozzle further includes an assist air passage arranged to allow the passage therethrough of assist air for assisting in atomization of the fuel injected from said injection nozzle.

56. An electronically controlled fuel injection device according to claim 48, wherein said plunger has a solid end part to block fuel flow through said passage of said plunger-receiving body.

57. An electronically controlled fuel injection device comprising:

a positive displacement, electromagnetically driven pump comprising a plunger-receiving body having a passage extending therethrough, and a plunger reciprocally disposed in said passage of said plunger-receiving body, an operating chamber being defined at least partially in said plunger-receiving body at one end of said plunger, said electromagnetically driven pump being arranged to perform a fuel-suction stroke to reduce pressure in said operating chamber to draw fuel thereinto from a fuel tank, and a pressure-feeding stroke, having an initial stage and a later stage, for use in pumping fuel under pressure from said operating chamber;

an inlet orifice nozzle operably coupled to said operating chamber and having an inlet nozzle orifice part arranged to allow passage therethrough of the fuel in said operating chamber when pumped by said electromagnetically driven pump;

an injection nozzle, operably coupled to said inlet orifice nozzle and arranged to be coupled to an intake passage of an engine, so as to inject the fuel that has passed through said inlet orifice nozzle into the intake passage of the engine when the pressure of the fuel reaches at least a first specified pressure;

a circulation passage arranged to be operably coupled to the fuel tank to allow circulation of the fuel front said operating chamber back to the fuel tank when the fuel in said operating chamber is pressurized to a second specified pressure by said electromagnetically driven pump; and a control arrangement operably coupled to said electromagnetically driven pump to control said electromagnetically driven pump in response to a cycle of the engine.

58. An electronically controlled fuel injection device according to claim 57, wherein said circulation passage passes through said plunger in said first and second opposing directions;

a pressurizing valve is arranged to normally block said circulation passage, and to open said circulation passage when the fuel pressure-fed by said plunger reaches at least said first specified pressure.

59. An electronically controlled fuel injection device according to claim 57, wherein said circulation passage is formed on an outside of said plunger-receiving body of said electromagnetically driven pump; and a pressurizing valve is arranged to normally block said circulation passage, and to open said circulation passage when the fuel pressure-fed by said plunger reaches at least said first specified pressure.

60. An electronically controlled fuel injection device according to claim 59, wherein a spill port is formed in said plunger-receiving body and communicates with said circulation passage; and said plunger is arranged to open said spill port in said initial stage of said pressure-feeding stroke and to close said spill port in said later stage of said pressure-feeding stroke.

61. An electronically controlled fuel injection device according to claim 60, wherein said circulation passage and said injection nozzle are arranged so that fuel being returned to the fuel tank by said circulation passage is circulated in a direction opposite to a direction in which fuel is injected by said injection nozzle.

62. An electronically controlled fuel injection device according to claim 57, wherein said circulation passage and said injection nozzle are arranged so that fuel being returned to the fuel tank by said circulation passage is circulated in a direction opposite to a direction in which fuel is injected by said injection nozzle.

63. An electronically controlled fuel injection device according to claim 57, wherein said injection nozzle comprises:

a valve-receiving body having an injection nozzle fuel passage communicating with said inlet orifice nozzle to conduct fuel from said inlet orifice nozzle;

an injection nozzle valve body arranged for reciprocating motion in said valve-receiving body to open and close said injection nozzle fuel passage; and an urging spring operably engaged with said injection nozzle valve body to urge said injection nozzle valve body toward a position to close said injection nozzle fuel passage.

64. An electronically controlled fuel injection device according to claim 59, wherein said injection nozzle further includes an assist air passage arranged to allow the passage therethrough of assist air for assisting in atomization of the fuel injected from said injection nozzle.

65. An electronically controlled fuel injection device according to claim 59, wherein said injection nozzle further includes an adjustment mechanism for adjusting an urging force of said urging spring.

66. An electronically controlled fuel injection device according to claim 57, wherein said electromagnetically driven pump and said injection nozzle are formed as an integral unit.

67. An electronically controlled fuel injection device according to claim 57, wherein said plunger has a solid end part to block fuel flow through said passage of said plunger-receiving body.

* * * * *